US006776442B2

(12) United States Patent
Edgar

(10) Patent No.: US 6,776,442 B2
(45) Date of Patent: Aug. 17, 2004

(54) LATCH APPARATUS AND METHOD

(75) Inventor: James R. Edgar, Shorewood, WI (US)

(73) Assignee: Strattec Security Corporation, Milwaukee, WI (US)

( * ) Notice: Subject to any disclaimer, the term of this patent is extended or adjusted under 35 U.S.C. 154(b) by 0 days.

(21) Appl. No.: 09/975,649

(22) Filed: Oct. 11, 2001

(65) Prior Publication Data

US 2002/0089188 A1 Jul. 11, 2002

Related U.S. Application Data

(60) Provisional application No. 60/260,420, filed on Jan. 9, 2001.

(51) Int. Cl.[7] ..... E65C 3/06

(52) U.S. Cl. ..... 292/216; 292/201

(58) Field of Search ..... 292/201, 216, 292/DIG. 23; 70/264

(56) References Cited

U.S. PATENT DOCUMENTS

| | | | |
|---|---|---|---|
| 1,611,838 | A | 12/1926 | Malicki |
| 2,802,357 | A | 8/1957 | Smith |
| 2,910,859 | A | 11/1959 | Allen et al. |
| 2,955,864 | A | 10/1960 | Van Voorhees |
| 3,121,580 | A | 2/1964 | Di Salvo et al. |
| 3,563,589 | A | 2/1971 | Kwasiborski, Jr. |
| 3,767,242 | A | 10/1973 | Quantz |
| 3,889,501 | A | 6/1975 | Fort |
| 4,056,276 | A | 11/1977 | Jarvis |
| 4,097,077 | A | 6/1978 | Gahrs |
| 4,289,342 | A | 9/1981 | Bemm et al. |
| 4,386,798 | A | 6/1983 | Menard |
| 4,518,180 | A | 5/1985 | Kleefeldt et al. |
| 4,617,812 | A | 10/1986 | Rogers |
| 4,637,239 | A | 1/1987 | Kleefeldt et al. |
| 4,656,850 | A | 4/1987 | Tabata |
| 4,824,152 | A | 4/1989 | Jeavons |
| 4,887,390 | A | 12/1989 | Boyko et al. |
| 4,948,183 | A | 8/1990 | Yamada |

(List continued on next page.)

FOREIGN PATENT DOCUMENTS

| | | |
|---|---|---|
| DE | 355578 | 6/1922 |
| DE | 538812 | 11/1929 |
| DE | 685943 | 12/1939 |
| DE | 412970 | 3/1993 |
| DE | 19527565 | 1/1997 |
| DE | 19547727 A1 | 6/1997 |
| DE | 29701390 | 11/1997 |
| EP | 0169644 | 1/1986 |

(List continued on next page.)

*Primary Examiner*—Gary Estremsky
(74) *Attorney, Agent, or Firm*—Michael Best & Friedrich LLP

(57) ABSTRACT

In some embodiments of the present invention, a lever is actuatable to unlatch a pawl when the lever is in an unlocked position. When the lever is in a locked position, lever actuation cannot unlatch the pawl. An over-center device coupled to the lever can be used to position the lever in its locked and unlocked positions. In these and other embodiments, the lever is moved away from the pawl when the lever is in a locked position and is moved closer to the pawl when the lever is in an unlocked position. In some embodiments, the lever is pivotable about a pivot point that remains in the same location with respect to the lever in the unlocked and locked positions thereof. Although not required, the pawl is preferably movable by the lever to its unlatched state after the partially or fully-actuated lever has been moved to its unlocked state.

48 Claims, 10 Drawing Sheets

U.S. PATENT DOCUMENTS

| | | | | | |
|---|---|---|---|---|---|
| 4,986,098 | A | | 1/1991 | Fisher | |
| 4,995,248 | A | | 2/1991 | Liu | |
| 5,029,915 | A | | 7/1991 | Wilkes | |
| 5,037,145 | A | | 8/1991 | Wilkes | |
| 5,046,377 | A | | 9/1991 | Wilkes et al. | |
| 5,074,603 | A | | 12/1991 | Brackmann | |
| 5,142,890 | A | | 9/1992 | Uyeda et al. | |
| 5,236,234 | A | | 8/1993 | Norman | |
| 5,277,461 | A | * | 1/1994 | Dzurko | 292/216 |
| 5,307,656 | A | | 5/1994 | Gartner et al. | |
| 5,308,128 | A | | 5/1994 | Portelli et al. | |
| 5,350,206 | A | | 9/1994 | Akahori et al. | |
| 5,423,582 | A | | 6/1995 | Kleefeldt | |
| 5,531,488 | A | | 7/1996 | Yoshikuwa et al. | |
| 5,538,298 | A | | 7/1996 | Ikeda | |
| 5,547,208 | A | | 8/1996 | Chappell et al. | |
| 5,561,997 | A | | 10/1996 | Milman | |
| 5,577,782 | A | | 11/1996 | Johnson et al. | |
| 5,603,539 | A | | 2/1997 | Gruhn et al. | |
| 5,636,880 | A | | 6/1997 | Miller et al. | |
| 5,676,003 | A | | 10/1997 | Ursel et al. | |
| 5,697,236 | A | | 12/1997 | Kleefeldt et al. | |
| 5,722,272 | A | | 3/1998 | Bridgeman et al. | |
| 5,727,825 | A | | 3/1998 | Spurr | |
| 5,732,988 | A | | 3/1998 | Mizuki | |
| 5,758,912 | A | | 6/1998 | Hamada | |
| 5,765,884 | A | | 6/1998 | Armbruster | |
| 5,769,468 | A | | 6/1998 | Armbruster | |
| 5,785,364 | A | | 7/1998 | Kleefeldt et al. | |
| 5,802,894 | A | * | 9/1998 | Jahrsetz | 70/264 |
| 5,803,515 | A | * | 9/1998 | Arabia | 292/216 |
| 5,844,470 | A | | 12/1998 | Garnault et al. | |
| 5,881,589 | A | | 3/1999 | Clark et al. | |
| 5,901,991 | A | | 5/1999 | Hugel et al. | |
| 5,921,594 | A | | 7/1999 | Bendel | |
| 5,921,595 | A | * | 7/1999 | Brackmann | 292/216 |
| 5,931,034 | A | | 8/1999 | Fisher | |
| 5,961,163 | A | * | 10/1999 | Brackmann | 292/201 |
| 5,971,449 | A | * | 10/1999 | Rogers | 292/216 |
| 5,992,194 | A | | 11/1999 | Baukholt et al. | |
| 6,050,620 | A | | 4/2000 | Rogers, Jr. et al. | |
| 6,062,613 | A | | 5/2000 | Jung et al. | |
| 6,079,237 | A | | 6/2000 | Hochart | |
| 6,082,158 | A | | 7/2000 | Wegner | |
| 6,126,212 | A | * | 10/2000 | Fujihara | 292/216 |
| 6,148,651 | A | | 11/2000 | Roncin | |
| 6,168,215 | B1 | | 1/2001 | Kodama et al. | |
| 6,254,148 | B1 | | 7/2001 | Cetnar | |
| 6,286,878 | B1 | * | 9/2001 | Hochart | 292/216 |
| 6,338,508 | B1 | | 1/2002 | Kleefeldt | |
| 6,345,846 | B1 | | 2/2002 | DeRees et al. | |
| 6,390,516 | B1 | * | 5/2002 | Kobayashi | 292/201 |
| 6,485,071 | B2 | * | 11/2002 | Schwaiger | 292/216 |

FOREIGN PATENT DOCUMENTS

| | | |
|---|---|---|
| EP | 285412 | 10/1988 |
| EP | 0694665 | 1/1996 |
| FR | 2746840 | 10/1997 |
| GB | 5427 | of 1911 |
| GB | 1563368 | 3/1980 |
| GB | 2034801 | 6/1980 |
| GB | 0743413 | 11/1996 |
| IT | 413637 | 5/1946 |
| WO | WO90/05822 | 5/1990 |
| WO | WO00/20710 | 4/2000 |

* cited by examiner

LATCH APPARATUS AND METHOD

CROSS REFERENCE TO RELATED APPLICATION

This patent application claims priority to U.S. Provisional Patent Application No. 60/260,420 filed on Jan. 9, 2001, the entirety of which is incorporated herein by reference.

FIELD OF THE INVENTION

The present invention relates to latches and latching methods, and more particularly to devices and methods for controlling a latch in its locked and unlocked states and for switching a latch between such states.

BACKGROUND OF THE INVENTION

Conventional latches are used to restrain the movement of one member or element with respect to another. For example, conventional door latches restrain the movement of a door with respect to a surrounding door frame. The function of such latches is to hold the door secure within the door frame until the latch is released and the door is free to open. Existing latches typically have mechanical connections linking the latch to actuation elements such as handles which can be actuated by a user to release the latch. Movement of the actuation elements is transferred through the mechanical connections and (if not locked) can cause the latch to release. The mechanical connections can be one or more rods, cables, or other suitable elements or devices. Although the following discussion is with reference to door latches (e.g., especially for vehicle doors) for purposes of example and discussion only, the background information and the disclosure of the present invention provided applies equally to a wide variety of latches used in other applications.

Most current vehicle door latches contain a restraint mechanism for preventing the release of the latch without proper authorization. When in a locked state, the restraint mechanism blocks or impedes the mechanical connection between a user-operable handle (or other door opening device) and a latch release mechanism, thereby locking the door. Many conventional door latches also have two or more lock states, such as unlocked, locked, child locked, and dead locked states. Inputs to the latch for controlling the lock states of the latch can be mechanical, electrical, or parallel mechanical and electrical inputs. For example, by the turn of a user's key, a cylinder lock can mechanically move the restraint mechanism, thereby unlocking the latch. As another example, cable or rod elements connecting a door lock to the restraint mechanism can be controlled by one or more electrical power actuators. These actuators, sometimes called "power locks" can use electrical motors or solenoids as the force generator to change between locked and unlocked states.

An important issue with regard to the design of latch assemblies is the desirability of a latch assembly to operate smoothly. Unless friction is employed to retain one or more elements in desired positions in the latch assembly, low-friction contact (such as contact between rotatably-connected elements) is preferred. In addition, latch assembly designs in which part wear is reduced or eliminated is highly desirable. These latch assembly design considerations significantly limit the number of viable solutions for a number of latch assembly design problems described below.

In most conventional latch designs, one or more elements are moved to release a retaining element holding the latch in a latched position. For example, a pawl can be movable to release a ratchet holding the striker of the latch. The pawl (or other movable element used to hold the ratchet in a latched position) can be moved in many different manners, such as by being rotated, pushed, pulled, shifted, and the like. Typically, one or more elements such as levers are movable by actuation of a handle or other latch assembly input to move the pawl. These pawl-moving elements can be connected directly to the pawl or can otherwise be moved to exert motive force upon the pawl. In either case, preventing inadvertent movement of the pawl by these pawl-moving elements is another important design consideration, and can be accomplished by controlling the position and mobility of the pawl-moving elements in the latch assembly. Such inadvertent movement can be caused in some conventional latch assemblies by employing pawl-moving elements that have a mass close to the pawl and that can react to shock or severe vibration to impart force upon the pawl, by severe impact upon the latch (such as experienced in a vehicle collision or rollover), and by other manners.

Because many pawl-moving elements have locked and unlocked states as described above, such elements must often be moved or movable in different manners corresponding to the locked and unlocked states. Such movement can limit the ability to fully secure and control the pawl-moving element within the latch assembly (both highly desirable features of pawl-moving elements). Therefore, the possible manners in which pawl-moving elements can be connected and move within latch assemblies is often significantly limited.

It is possible to add structure and elements to conventional door latch designs in order to address the above-noted problems and to take into account the latch assembly design considerations described above. However, such additional structure and elements are likely to increase latch complexity. Increased latch complexity also increases assembly and repair cost. Accordingly, the reasonable door latch design alternatives available to address the above-noted problems and design considerations of conventional door latches are significantly limited.

Problems of latch weight and size are related to the problem of latch complexity. The inclusion of more elements and more complex mechanisms within the latch generally undesirably increases the size and weight of the latch. In virtually all vehicle applications, weight and size of any component is a concern. Therefore, many latch designs employing additional structure and elements to address the above-noted problems and to take into account the design considerations described above do so at an unacceptable cost of increased latch weight and size.

Regardless of the mechanism employed to change the locked state of a latch assembly (to disable or enable a mechanical or electrical input to the latch assembly), another problem common to the vast majority of conventional door latches relates to the inability of such door latches to properly respond to multiple inputs at a given time. A well-recognized example of this problem is the inability of most conventional door latches to properly respond to a user unlocking the door latch while the door handle is partially or fully actuated. While this problem can exist for door latches that are not powered, it is particularly problematic in powered latches. For example, a user of a keyless entry system can push a button on a key fob, enter an access code on a door keypad, or otherwise transmit a signal (by wire or wirelessly) to a controller in the vehicle that in turn sends a signal to power unlock a handle input to the latch. In conventional power latches, an amount of time is required for this process to take place. During this time, a user may attempt to unlatch the latch by actuating the handle input. Because the latch has not yet been unlocked, such actuation does nothing—even after the latch has been powered to its unlocked state while the handle input is in a partially or fully actuated position. The user must release the handle, transmit another unlocking signal to power unlock the handle, and then re-actuate the handle to unlatch the latch. In other words, to unlatch a conventional latch, actuation of the handle input must occur after the handle input has been placed in its unlocked state. Partial or full actuation of the handle input before this time will not unlatch the latch and will require the user to release and re-actuate the handle input.

This shortcoming of conventional door latches exists for powered and fully manual door latches alike. In addition to requiring the user to re-actuate an input to unlatch the unlocked latch, this problem can even prevent the latch from changing between its locked and unlocked states. In such a case, the user is required to unlock the latch assembly again (re-transmit a signal to the latch assembly or manually unlock the latch assembly again as described above) after the handle input has been released. Any of the results just described represent an annoying attribute of conventional latch assembly designs. In this and other examples, a conventional latch assembly is unable to respond to actuation of more than one input at a time, or is only responsive to one of two inputs actuated simultaneously or closely in time.

In light of the problems and limitations of the prior art described above, a need exists for a latch assembly that is relatively simple in construction, lightweight, reliable, and easy to assemble and maintain, operates smoothly and efficiently with minimal friction and wear, has pawl-moving elements having improved control and stability, is preferably able to properly respond to an unlocking/locking input and to an latching/unlatching input received simultaneously or closely in time, and does so with minimal to no additional latch assembly elements and structure. Each preferred embodiment of the present invention achieves one or more of these results.

SUMMARY OF THE INVENTION

Some preferred embodiments of the present invention employ a pawl releasably engagable with a ratchet latching the door in place, a user-manipulatable handle, a lever movable between an unlocked position in which actuation of the lever by the handle generates sufficient pawl movement to release the ratchet and a locked position in which actuation of the lever by the handle does not generate sufficient pawl movement to release the ratchet, and a locking and unlocking mechanism coupled to the lever for moving the lever between its unlocked and locked positions. In some highly preferred embodiments, the locking and unlocking mechanism is an over-center device capable of moving the lever between its unlocked and locked positions. Also, the lever in some highly preferred embodiments is pivotable about the same or substantially the same location with respect to the lever in the locked and unlocked positions of the lever. In either case and in still other embodiments, the lever can be moved (e.g., by the locking and unlocking mechanism) between a locked position in which the mass of the lever or portion thereof is removed a distance from the pawl and an unlocked position in which the mass of the lever or portion thereof is moved closer to the pawl.

A significant amount of control over the lever is possible when the lever is pivotable in the locked and unlocked positions about the same or substantially the same location with respect to the lever. This location can be (and in some embodiments is) a location where the locking and unlocking mechanism is attached to the lever. By moving this point about which the lever pivots in its various states, the lever can be reliably moved to different locations with respect to the pawl while maintaining a degree of control over lever orientation and action. The pivot point of the lever can be in the same place or substantially the same place with respect to the lever in all positions of the lever in the latch assembly or in only a locked position and an unlocked position of the lever in the latch assembly. Also, the lever can be moved between its locked and unlocked positions by translating and/or rotating the lever or by moving the lever in any other manner desired.

In some embodiments of the present invention, additional control over the lever used to move the pawl is achieved by use of an over-center locking and unlocking mechanism. Specifically, an over-center device can be used to move the lever between its locked and unlocked positions. The over-center device has at least two stable positions separated by an unstable "center" position. Therefore, when the over-center device is actuated to one side of the center position, the lever connected thereto remains on that side until the over-center device is actuated to the opposite side of the center position. In this manner, the lever can be placed by the over-center device in a locked state in which the lever is in one position with respect to the pawl and in an unlocked state in which the lever is in another position with respect to the pawl. In some embodiments, the over-center device is biased away from the center position in either or both directions, thereby further retaining the lever in its locked or unlocked state until the over-center device is actuated again. In other embodiments, the over-center device is not biased away from the center position in one or both directions. In such embodiments, actuation of the lever can draw the over-center device further away from the center position, thereby ensuring that the lever stays in the locked or unlocked state to which it has already been moved.

The over-center device can take a number of different forms. For example, the over-center device can be or include two elements that are rotatably coupled together at a first pivot point. One of the two elements can be mounted for pivotal movement about a second pivot point and the other element can be pivotably connected at a third pivot point to the lever used to move the pawl. By rotating either element of the over-center device, the other element also rotates and causes the lever to move with respect to the pawl. In some embodiments, the center position of such an over-center device is defined by a line passing through the second and third pivot points, whereby the position of the first pivot with respect to either side of the line determines whether the lever is in a locked or unlocked state.

The two elements in the over-center device just described can take a number of different forms, such as an elongated bar pivotably coupled at one end to the lever and at another end to an edge of a disc that is rotatable about its axis, two links connected in a similar manner, and the like. Other types of over-center devices can be employed, such as an over-center device having a first element connected to or capable of moving the pawl and biased against an inclined surface of a second element. The two stable positions of the over-center device are defined by the first element located at the "top" and "bottom" of the inclined surfaces of the second element, respectively (whereby the first element can be retained in a recess, at plateau, on a step, or by another feature located at the top of the inclined surface of the second element). In yet another type of over-center device, a first element is connected to or is otherwise capable of moving the pawl and is biased against the surface of a rotatable second element. The surface is preferably eccentric with respect to the rotational axis of the second element. Therefore, the two stable positions of the over-center device are defined by the first element located at two different rotational positions of the second element (e.g., rotated toward the first element and rotated away from the first element). Still other types of over-center devices can be used as desired.

Although some embodiments of the present invention employ an over-center device with a lever that is pivotable about substantially the same position with respect to the lever in the locked and unlocked states thereof, it should be noted that any other locking and unlocking mechanism can be employed to move the lever as described above. For example, the locking and unlocking mechanism can be a solenoid, hydraulic or pneumatic cylinder, or any other type of actuator. Also, the over-center device can be employed to position a lever that is pivotable about different points with respect to the lever in the locked and unlocked states thereof.

It is desirable in some applications to remove the lever (used to move the pawl) a distance away from the pawl when the lever is in a locked state. More specifically, the mass of the lever that is located nearest to the pawl when the lever is in its unlocked state is preferably removed a distance from the pawl when the lever is in its locked state. In this manner, the opportunity for the lever to be forced toward and against the pawl when the lever is in its locked state is further reduced. For example, protection is increased against lever movement against the pawl causing pawl release as a result of shock, impact, or severe vibration of the latch assembly, such as from a vehicle collision or rollover. Preferably, an over-center device coupled to the lever can be used to move the mass of the lever toward and away from the pawl in the unlocked and locked states of the lever, respectively. However, any locking and unlocking mechanism can be employed to move the lever for this purpose.

In some preferred embodiments of the present invention, the latch assembly is capable of properly responding to unlatching and unlocking inputs received at the same time or closely in time. In other words, when the lever used to move the pawl is actuated before or while a locking and unlocking mechanism is placed in its unlocked state, the latch assembly properly responds by unlatching the latch upon movement of the locking and unlocking mechanism to the unlocked state. In one preferred application involving a car door latch capable of being unlocked via a remote keyless entry system, the user can partially or fully actuate the door handle prior to unlocking the door or while the door is being unlocked (e.g., while the keyless entry system is still processing the request to unlock the latch assembly, during movement of the locking and unlocking mechanism to its unlocked state, and the like). The latch assembly responds by unlatching the latch when the latch assembly is finally unlocked, and does so without requiring the user to release and re-actuate the door handle. Although the other embodiments of the present invention described above can operate without this feature, such latch assembly embodiments preferably have this capability.

More information and a better understanding of the present invention can be achieved by reference to the following drawings and detailed description.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF THE PREFERRED EMBODIMENTS

Figure 1:
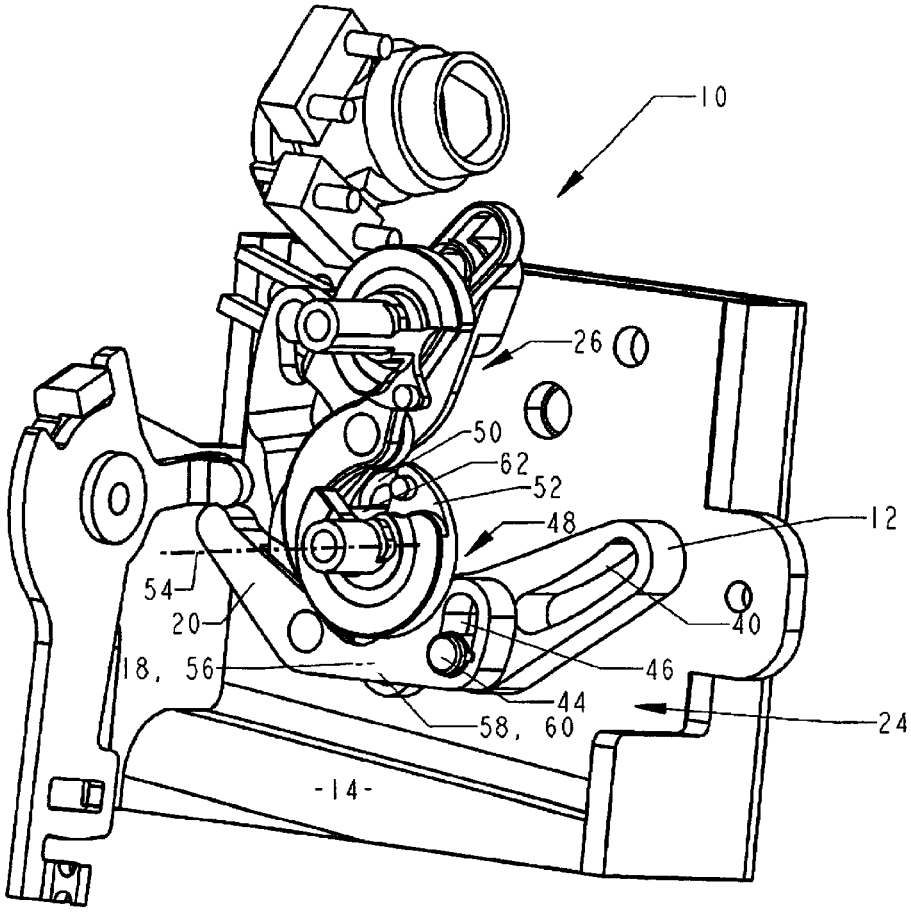
FIG. 1 is a perspective view of a latch assembly according to a preferred embodiment of the present invention, shown with an outside door handle mechanism of the latch assembly in a locked state and in an actuated position.

An example of a latch assembly according to a preferred embodiment of the present invention is illustrated in FIG. 1. Only that portion of the latch assembly necessary for an understanding of the present invention is shown in FIG. 1. Accordingly, a number of latch assembly elements are not shown in FIG. 1 for purposes of clarity. The latch assembly of the present invention (indicated generally at 10 in FIG. 1) is described hereinafter with reference to use in a vehicle door application. However, it should be noted that the latch assembly 10 can instead be used in many other applications. The present invention can be used in any application in which it is desirable to releasably secure one body to another. Such applications can be non-automotive and need not involve doors.

In most vehicle door latch applications, a latch will have a connection to an inside door handle, an outside door handle, an inside lock, and possibly an outside lock (e.g., usually for front doors of a vehicle). Each of these connections represents an input to the latch. Typically, latch inputs are operable either to generate latch release or to enable or disable such an input. Inputs for generating latch release usually run from a user-manipulatable device such as a lever located inside or outside of the vehicle. Inputs for enabling and disabling these latch release inputs can also run from a user-manipulatable device inside or outside of the vehicle, such as a lock cylinder, a sill button, an electrical controller or user-operable electronic device such as a keypad or remote access electronic system connected to the latch assembly, and the like. Regardless of what mechanical or electrical controls are employed to control and trigger latching, unlatching, and latch input enabling and disabling, virtually every vehicle latch has a mechanism for ultimately performing these functions.

The latch assembly in the illustrated preferred embodiment has two latch inputs for generating latch release (i.e., "latch release inputs") and two latch inputs for enabling and disabling these latch release inputs (i.e., "locking and unlocking inputs"). Other latch assemblies embodying the present invention can have fewer or greater numbers of latch release inputs and locking and unlocking inputs. With particular reference to FIG. 1, one of the latch release assemblies 24 is at least partially defined by a control lever 12 pivotably mounted within the latch assembly housing 14 and an actuating lever (not shown) pivotably mounted to actuate the control lever 12 about a pivot 18. Another latch release assembly 26 includes another control lever 20 and an actuating lever (also not shown) pivotably mounted to actuate the control lever 20. As will be described in greater detail below, actuation of an actuating lever when the corresponding control lever 12, 20 is in its unlocked state will unlatch the latch assembly 10. Actuation of an actuating lever when the corresponding control lever 12, 20 is in its locked state will not unlatch the latch assembly 10.

Figure 2:
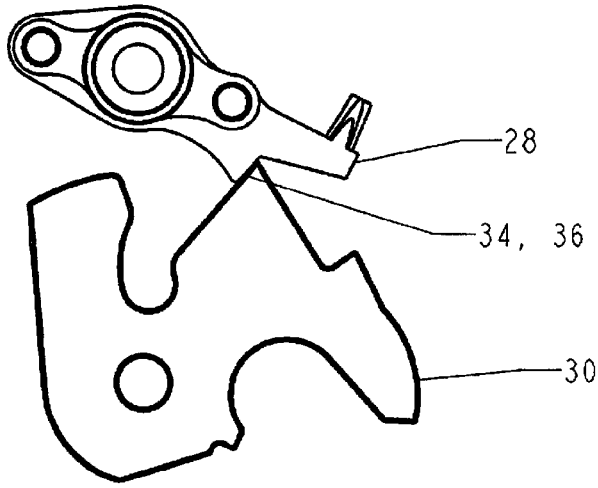
FIG. 2 is an elevational view of the ratchet and pawl mechanism in the latch assembly of FIG. 1.

With reference to FIG. 2, the latch assembly 10 preferably has a ratchet and pawl mechanism to latch a door in its closed position. In this mechanism, the ratchet 30 and striker (not shown) releasably engage one another, and can be mounted in any conventional manner on the door and its respective door jam for movement relative to one another. For example, the striker can be mounted upon a door jam, while the latch assembly 10 and ratchet 30 can be mounted on a vehicle door movable to a closed position in which the striker enters an aperture 32 in the ratchet 30 and is trapped therein upon resulting movement of the ratchet 30. Alternatively, the striker can be mounted upon the vehicle door, while the latch assembly 10 and ratchet 30 are mounted upon the door jam. In either case, the ratchet 30 is preferably movable between a latched position in which a striker is trapped in the ratchet aperture 32 and an unlatched position in which the striker is free to exit the ratchet aperture 32. This ratchet movement can be (and preferably is) rotational, whereby the ratchet 30 is mounted to rotate about a pivot. However, other forms of ratchet movement are possible. To capture the striker, the ratchet 30 usually cooperates with the latch assembly housing 14 so that the striker is captured by the walls of the ratchet aperture 32 and by a wall or other portion of the latch assembly housing 14 when the ratchet 30 is in its latched position. It should be noted that other forms of striker capture are also possible, and need not necessarily employ purely rotational ratchet movement or any type of rotational ratchet movement. Also, the shape of the ratchet and striker can vary significantly while still performing the function of releasably capturing the striker via movement of the ratchet 30 when engaged therewith. One having ordinary skill in the art will recognize that many different striker and ratchet designs and arrangements are possible.

Regardless of how the ratchet 30 moves and how it captures a striker, the pawl 28 preferably cooperates with the ratchet 30 to hold the ratchet 30 in a particular position or state. The ratchet 30 is most preferably releasably engagable by the pawl 28 to hold the ratchet 30 in its latched state. Although such an arrangement is described hereinafter, it should be noted that the pawl 28 can be releasably engagable with the ratchet 30 to hold the ratchet 30 in its unlatched state in other latch embodiments. One pawl design is shown in FIG. 2 by way of example only. The pawl 28 shown in FIGS. 1 and 2 can take a number of different shapes. In addition, one having ordinary skill in the art will appreciate that numerous mechanisms for releasably capturing a striker exist in the art and can be employed in conjunction with the present invention as described in greater detail below.

With continued reference to FIG. 2, the pawl 28 is pivotable into and out of engagement with the ratchet 30, and has an engagement portion 34 that obstructs movement of the ratchet 30 to its unlatched position by engagement with a step 36 on the ratchet 30. In another example, the pawl 28 is pivotable into and out of engagement with a lip, ledge, peg, abutment, boss, tooth, or other element or feature of the ratchet 30. Because the ratchet 30 is preferably spring-loaded toward its unlatched position, disengagement of the pawl 28 from the ratchet 30 permits the ratchet 30 to move and to thereby release a striker (not shown). Rotation of the pawl 28 therefore generates striker release. Like the ratchet 30, the pawl 28 can take any form capable of releasably engaging with the ratchet 30 to selectively limit ratchet movement.

Although other conventional forms of pawl movement (e.g., translation or a combination of translation and rotation) to engage and disengage the ratchet 30 are possible and fall within the spirit and scope of the present invention, a rotatable pawl 28 is most preferred. Accordingly, and with reference to the illustrated preferred embodiments of the present invention, rotation of the pawl 28 is preferably performed to disengage the ratchet 30 and thereby to unlatch the latch assembly 10.

Because the pawl 28 functions to retain the ratchet 30 in a latched state until the pawl 28 is actuated to its unlatched position, the latch assembly 10 is preferably controlled by control of pawl movement and position in the latch assembly 10. To this end, the control levers 12, 20 can be actuated to move the pawl 28. Any number of control levers 12, 20 can be employed for this purpose, each control lever 12, 20 being connected to one or more latch release inputs (not shown). In some highly preferred embodiments, each control lever 12, 20 is movable in at least two different manners. In at least one manner, the control lever 12, 20 can move the pawl 28 to release the ratchet 30 (thereby unlatching the latch 10). A control lever 12, 20 movable in this manner is therefore in an unlocked state. In at least one other manner, the control lever 12, 20 cannot move the pawl 28 to release the ratchet 30, or at least cannot move the pawl 28 sufficiently to release the ratchet 30. A control lever 12, 20 movable in this manner is therefore in a locked state.

In the preferred embodiment illustrated in FIG. 1, the control levers 12, 20 are moved by actuation of respective actuating levers (not shown). The actuating levers can be translatable or rotatable in any manner to exert actuating force against the control levers 12, 20 in order to move the control levers 12, 20 when a corresponding door handle (or other latch release input) is actuated. Also, the actuating levers can be any shape desired. By way of example only, the actuating levers can be elongated, L or V-shaped, polygonal, round, or can have any other shape that can be connected to pivot or shift when actuated to exert actuating force upon a corresponding control lever 12, 20. The actuating levers can be connected to the control levers 12, 20, such as by a pinned connection, a ball joint, a hinge, a spring, and the like, or can interact with the control levers 12, 20 through a camming, pushing, or other motion.

One example of the manner in which the control levers 12, 20 can be connected to actuating levers is illustrated in FIGS. 1 and 3–7. Specifically, the control lever 12 illustrated on the bottom of FIG. 1 is preferably rotatably connected to an actuating lever (not shown) by a pin-and-aperture connection. The actuating lever preferably has a pin, post, or other extension received within an aperture 40 in the control lever 12. The locations of the pin and aperture 40 can be reversed in alternative embodiments.

In the illustrated preferred embodiment, the control lever 12 is connected to an outside door handle by the actuating lever (not shown). Force from the outside door handle can be transmitted to the actuating lever and thereby to the control lever 12 by any number of different elements and connections. For example, one or more rods, cables, wires, levers, or other elements can extend from the door handle to the actuating lever for this purpose. Alternatively, the actuating lever itself can be connected directly to the door handle for actuation thereby.

The inside and outside door handles connected to the latch assembly 10 can preferably be locked and unlocked by placing the latch release assemblies 24, 26 in their locked and unlocked states, respectively. In other latch assembly embodiments, not all of the latch release inputs to the latch assembly 10 have this capability of being locked and unlocked.

For purposes of describing the present invention, the latch release assembly 24 for the outside door handle of the illustrated preferred embodiment in FIG. 1 will be described in greater detail below. However, the following description applies equally to latch release assemblies directly or indirectly connected to other manual and automatic actuation devices (i.e., to devices other than door handles) and even to latch assemblies not associated with a door. In addition, although in the illustrated preferred embodiment the present invention is employed only for the outside door handle latch release assembly 24, any different or additional latch release assembly can employ the principles of the present invention (e.g., a latch release assembly for an inside door handle, latch release assemblies for both inside and outside door handles, and the like). Reference below to the outside door handle and the connection of the latch release assembly 24 thereto is therefore made by way of example only. In addition, each of the embodiments illustrated and described herein can have any number of latch release assemblies 24 for connection to any number of handles or other latch release inputs.

A number of elements which are likely to be found in a latch in conjunction with the latch assembly of the present invention are not essential for the present invention and are not therefore described further herein or shown in FIGS. 1–7. For example, although not necessary for the present invention, the latch assemblies of the present invention can be at least partially enclosed within a cover or outer housing (not shown). As another example, in some embodiments, the latch release assemblies 24, 26, pawl 28, and ratchet 30 are biased by springs (also not shown) in any conventional manner toward respective positions within the latch assembly 10 and have one or more stops, walls, or surfaces (also not shown) limiting the range of motion of these elements.

In the embodiment of the present invention illustrated in FIGS. 1–7, the pawl 28 is mounted for pivotal movement about a pawl pivot 42. The pawl pivot 42 can be an extension of the pawl 28, a pivot attached to the pawl 28 in any conventional manner (e.g., by a threaded fastener, by welding, brazing, adhesive, and the like), or can extend from or be otherwise connected to the housing 14 of the latch assembly 10. Therefore, by rotating the pawl 28 about the pawl pivot 42, the pawl 28 can be rotated to engage or disengage the ratchet 30 as described above.

The pawl 28 can be rotated by the control lever 12 in a number of different manners, such as by camming contact between surfaces of the pawl 28 and control lever 12, by an articulated joint between the pawl 28 and the control lever 12, by a pin on the pawl 28 or lever 12 received within an aperture in the lever 12 or pawl 28, respectively, and the like. By way of example only, the pawl 28 in the illustrated preferred embodiment has a post 44 against which the control lever 12 can push to rotate the pawl 28 about its pivot 42. In other embodiments, the control lever 12 can act against the pawl post 44 to move the pawl 28 in other manners (e.g., translation or a combination of translation and rotation) depending at least partially upon the manner in which the pawl 28 is mounted in the latch assembly 10. Also, one having ordinary skill in the art will appreciate that the control lever 12 can push or pull against other surfaces of the pawl 28 to generate movement thereof, such as against one or more edge surfaces of the pawl 28, interior surfaces of an aperture in the pawl 28, and the like.

Depending at least partially upon whether the control lever 12 is connected to the pawl 28 and upon which portion of the control lever 12 acts upon the pawl 28, motive force (i.e., force generating motion of an element) can be imparted to the pawl 28 by any interior or exterior surface of the control lever 12. For example, the outside handle control lever 12 in the latch assembly 10 illustrated in FIGS. 1–7 is connected to the pawl 28 by the pawl post 44 extending through an aperture 46 in the outside handle control lever 12 (see FIGS. 3–7). Therefore, actuation of the outside handle control lever 12 in its unlocked state (described below) causes an interior surface of the control lever aperture 46 to push against the pawl post 44 and to move the pawl 28. In some preferred embodiments of the present invention, the control lever aperture 46 is elongated or is otherwise shaped to permit lost motion of the pawl post 44 therein in at least one of the positions of the control lever 12.

Other control lever surfaces can push or pull the pawl post 44 or any other portion of the pawl 28 for generating motion of the pawl 28. By way of example only, the pawl post 44 can be pushed by an outer peripheral surface of the control lever 12. As another example, a pin, boss, or other extension of the control lever 12 can extend to a position adjacent to an edge of the pawl 28 for pushing the pawl 28 when the control lever 12 is actuated. This edge of the pawl 28 can be an outer peripheral edge or can be an edge of an aperture in the pawl 28. As yet another example, the pawl 28 and control lever 12 can be located in substantially the same plane so that when the control lever 12 is actuated in its unlocked state, a peripheral edge of the control lever 12 is brought into contact with a peripheral edge of the pawl 28 to move the pawl 28. Still other manners of transferring motive force from the control lever 12 to the pawl 28 are possible, each of which falls within the spirit and scope of the present invention.

As mentioned above, the control lever 12 has locked and unlocked states. In its locked state, the control lever 12 is incapable of moving the pawl 28 or is at least incapable of moving the pawl 28 sufficiently to release the ratchet 30 and to thereby unlatch the latch 10. In its unlocked state, the control lever 12 can move the pawl 28 to release the ratchet 30 and thereby unlatch the latch 10. A significant advantage of the latch assembly 10 illustrated in FIGS. 1–7 is that the control lever 12 is well controlled within the latch assembly 10 despite the fact that the control lever 12 can be moved through different ranges of positions in different locked and unlocked states. This is due at least in part to the manner in which the control lever 12 pivots in both states. In particular, the control lever 12 preferably has a pivot point that is the same in both the locked and unlocked states of the control lever 12. This pivot point can be located on or off of the control lever, but is preferably located in the same or substantially the same position with respect to the control lever 12 in both states of the control lever 12.

In other words, even though the control lever 12 can be moved to different positions in the latch assembly 10, the control lever 12 preferably pivots about the same or substantially the same point with respect to the control lever 12. The control provided by such control lever movement is superior to other latch assembly designs in which the control lever pivots about different points with respect to the control lever in its locked and unlocked states. In many preferred embodiments of the present invention, the control lever 12 pivots about the point at which a locking and unlocking mechanism is connected to the control lever 12. The locking and unlocking mechanism can be configured to orient the control lever 12 in its locked and unlocked states. This provides a significant amount of control over the control lever 12 regardless of whether the control lever 12 is in its locked or unlocked state and regardless of the position of the control lever 12.

The locking and unlocking mechanism in the various embodiments of present invention is an actuator or defines part of an actuator capable of moving the control lever 12 with respect to the pawl 28. A number of different locking and unlocking mechanisms can be employed to move the control lever 12 to different positions in the latch assembly 10 while still enabling the control lever 12 to pivot about the same or substantially the same pivot point with respect to the control lever 12. One such locking and unlocking mechanism is illustrated in FIGS. 1 and 3–7, and is indicated generally at 48. The locking and unlocking mechanism 48 can define or be part of an actuator capable of moving the control lever 12. The locking and unlocking mechanism 48 preferably has a first element 50 connected to a second element 52 which is mounted for rotation about an axis 54. In some preferred embodiments, the first element 50 is movable by the second element 52 between locked and unlocked positions with respect to the control lever 12.

The first element 50 is preferably a lever having an elongated shape as best shown in FIGS. 3–7, but can take any other shape desired. The first element 50 can be connected to the control lever 12 by the control lever pivot 18, which in one embodiment is a pin 56 received within apertures 58, 60 in the first element 50 and control lever 12, respectively. The control lever pivot 18 preferably permits relative rotation of the first element 50 with respect to the control lever 12. The control lever pivot 18 can be integral with the first element 50 or the control lever 12 or can be attached to the first element 50 or the control lever 12 in any conventional manner (such as by being press-fit, welded, brazed, glued, and the like). Alternatively, the control lever pivot 18 can be retained in apertures in the first element 50 and in the control lever 12 by one or more cotter pins, by a nut received on a threaded end of a pin 56, or by one or more other conventional fasteners. Other manners of pivotably connecting the first element 50 to the control lever 12 are possible, such as by a ball-and-socket joint, a hinge connection, and the like, each one of which falls within the spirit and scope of the present invention.

Either or both apertures 58, 60 in the first element 50 and control lever 12 of the illustrated preferred embodiment can be larger than the pin 56 to permit lost motion of the first element 50 with respect to the control lever 12. More preferably however, the pin 56 is similar in shape and size to both apertures 58, 60.

The first element 50 is preferably connected to the second element 52 at a distance from the axis of rotation 54 of the second element 52. Although not required, the first element 50 is rotatably connected to the second element 52 in any conventional manner, such as by a pivot on the first or second element 50, 52 received within an aperture in the second or first element 52, 50, respectively. For example, the first element 50 of the embodiment shown in FIGS. 1–7 preferably has an elongated aperture 62 in which a pivot post 64 is rotatably received. Still other manners of rotatable connection are possible and would be recognized by those of ordinary skill in the art.

The second element 52 can also take any shape desired, and is shown as a generally round, disc-shaped element in FIGS. 1 and 2–7 only by way of example and illustration. The second element 52 is preferably rotatable in one direction to a position or range of positions corresponding to an unlocked state of the locking and unlocking mechanism 48 and in another direction to a position or range of positions corresponding to a locked state of the locking and unlocking mechanism 48. In the illustrated preferred embodiment of FIGS. 1–7, the second element 52 is capable of only partial rotation in both directions.

With reference to FIGS. 3–7, the locking and unlocking mechanism 48 can be operated to move the control lever 12 between different positions in the latch assembly 10. These different positions define the locked and unlocked states of the control lever 12. Although any element or mechanism capable of moving the control lever 12 between different positions can be employed, an over-center device is most preferred. As will now be described, the locking and unlocking mechanism 48 illustrated in FIGS. 1 and 2–7 is an over-center device.

The "center" of the "over-center" locking and unlocking mechanism 48 is a rotational position of the second element 52. Specifically, this center is preferably the rotational position at which the axis of rotation 54 of the second element 52 is co-linear with the connection points of the first element 50 to the control lever 12 and second element 52 as shown in FIG. 7. This rotational position of the second element 52 is represented by the dotted line 66 on FIGS. 3–7. When the second element 52 is rotated in one direction away from this dotted line 66 (e.g., in the counter-clockwise direction with reference to FIGS. 3–7), the locking and unlocking mechanism 48 is in a locked state. When the second element 52 is rotated in an opposite direction away from this dotted line 66 (e.g., in the clockwise direction with reference to FIGS. 3–7), the locking and unlocking mechanism 48 is in an unlocked state.

In the illustrated preferred embodiment, the second element 52 has a limited rotational range in both directions defined by stops upon the pivot (not shown) about which the second element 52 rotates. In other preferred embodiments, rotation of the second element 52 is limited in either or both directions by one or more stops on the second element 52, the pivot (not shown) upon which the second element 52 is mounted for rotation, and/or a wall of the latch assembly 10. For example, a stop in the illustrated embodiment of FIGS. 1–7 is illustrated schematically as a dashed radial line in FIGS. 3–7. In any case, the first element 50 is movable to either side of a center orientation with respect to the second element 52 to result in different positions with respect to the control lever 12 (thereby resulting in different interaction with the control lever 12 when actuated). Rotational stops and their manner of operation are well known to those skilled in the art and are not therefore described further herein.

As alternatives to the use of stops on the second element pivot or stops contacting the second element pivot as described above, one having ordinary skill in the art will appreciate that rotation of the second element 52 can be limited in either or both directions in a number of different manners. By way of example only, one or more walls, posts, or other protrusions can extend from the second element 52 and can abut against and be stopped by one or more walls, posts, or other protrusions located adjacent to the second element 52, movement of the first element 50 can be limited by stops extending from the latch assembly housing 14 (see FIG. 1), a stop extending from the first or second elements 50, 52 can be received within and stopped by one or more ends of an aperture in the latch assembly housing 14, an extension or other peripheral portion of the second element 52 can abut one or more stops on a wall of the latch assembly housing 14 or other adjacent latch assembly structure, or a stop extending from the first element 50 can be received within and stopped by an aperture in the second element 52 (and vice versa) or can abut against an edge, side, wall, or other portion of the second element 52 (and vice versa). In still other embodiments, biasing members such as conventional springs can be connected to either or both of the first and second elements 50, 52 and to the latch assembly housing 14 or other assembly structure to limit second element rotation.

The stops described above can take any shape and form desired, including without limitation walls, posts, pins, fingers, ribs, bumps, flanges, bosses, or other protrusions or extensions, and can be integral with or connected to the associated element in any manner.

In operation, the second element 52 can be rotated to either side of the center position 66. Because the control lever 12 is connected to the second element 52 via the first element 50, rotation of the second element 52 changes the position of the control lever 12 with respect to the pawl 28. The control lever 12 can be moved in any direction or manner desired, depending at least partially on the manner in which the first element 50 is connected to the control lever 12 and where this connection is located on the control lever 12. In the illustrated preferred embodiment for example, the control lever 12 is movable generally vertically when the second element 52 is rotated. More specifically, rotation of the second element 52 causes the control lever 12 to pivot about or near its right end as shown in FIGS. 1 and 3–7. In this manner, the position of the control lever 12 is changed with respect to the pawl 28 as will now be described in greater detail.

Figure 3:
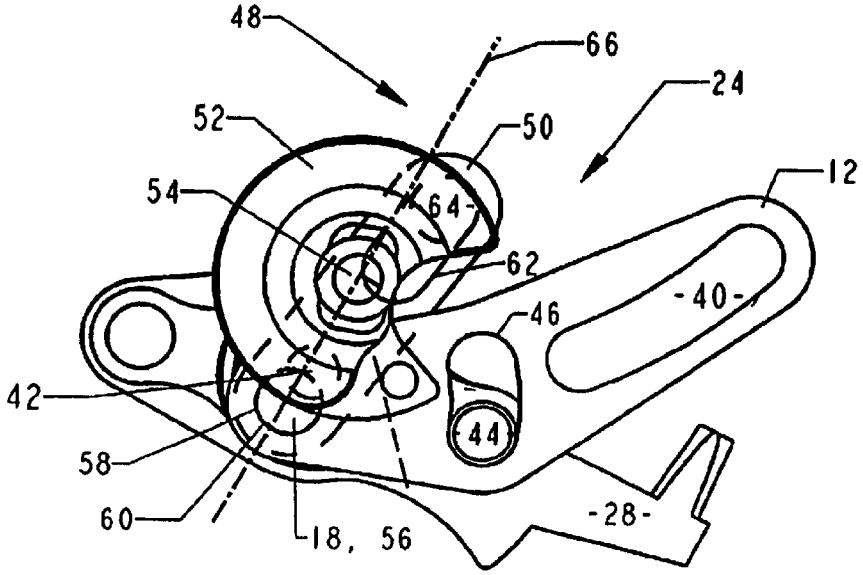
FIG. 3 is an elevational detail view of the latch assembly illustrated in FIG. 1, shown with the outside door handle mechanism in an unlocked and unactuated state.

When the second element 52 is rotated in a first direction past the center position 66 of the locking and unlocking mechanism 48 as shown in FIG. 3 of the illustrated preferred embodiment, the second element 52 is stopped by a stop as described above. Preferably, the second element 52 is spring-biased in this direction toward a stable position as also described above. When the control lever 12 is actuated in this position (rotated counter-clockwise as viewed in FIG. 4) the control lever 12 pivots about or near the control lever pivot 18 while the control lever 12 moves the pawl post 44 to release the pawl 28. Therefore, rotation of the pivot post 64 to the right of the center position 66 in FIGS. 3–7 defines the unlocked state of the control lever 12.

Figure 4:
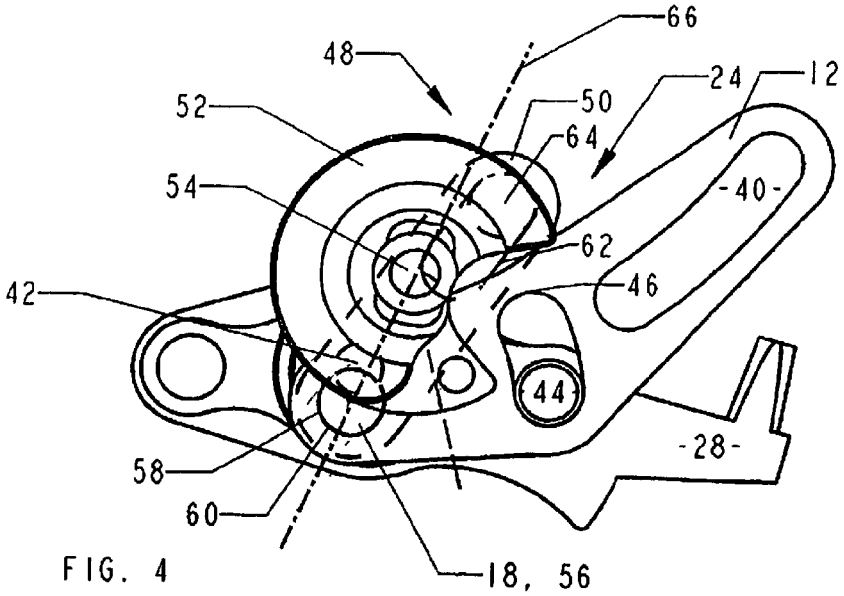
FIG. 4 is an elevational detail view of the latch assembly illustrated in FIG. 1, shown with the outside door handle mechanism in an unlocked and actuated state.
Figure 5:
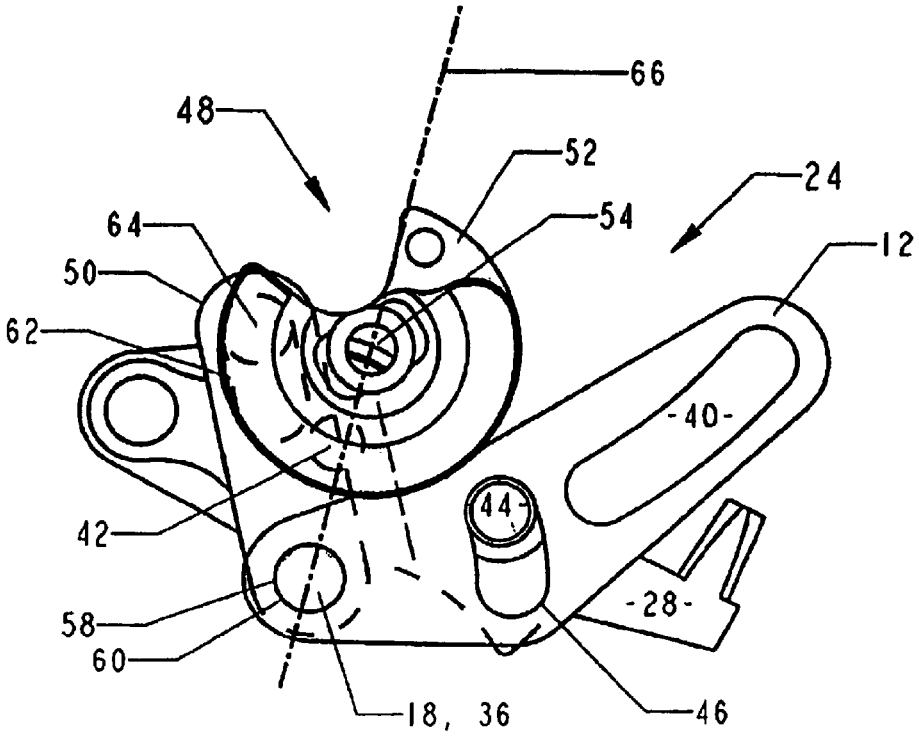
FIG. 5 is an elevational detail view of the latch assembly illustrated in FIG. 1, shown with the outside door handle mechanism in a locked and unactuated state.

When the second element 52 is rotated in a second direction opposite to the first direction and past the center position 66 of the locking and unlocking mechanism 48 as shown in FIG. 5 of the illustrated preferred embodiment, the second element 52 is preferably again stopped by a stop as described above. The second element 52 can be spring-biased in this direction as also described above. Rotation of the second element 52 in this direction is preferably limited so that the control lever pivot 18 is located at a lower elevation (as viewed in FIGS. 1–7) than when the second element 52 is fully rotated to its unlocked position described above. Therefore, when the control lever 12 is actuated in this position (rotated counter-clockwise as viewed in FIG. 6) the control lever 12 pivots about or near the control lever pivot 18. However, because the control lever 12 has been moved with respect to the pawl 28 by rotation of the second element 52, the aperture 46 in the control lever 12 is not positioned to move the pawl post 44 to release the pawl 28. Therefore, rotation of the pivot post 64 to the left of the center position 66 in FIGS. 3–7 defines the locked state of the control lever 12.

In some highly preferred embodiments, the first and second elements 50, 52 do not move or do not move significantly when the control lever 12 is actuated in either the locked state or the unlocked state of the locking and unlocking mechanism 48. However, in other embodiments, both elements are free to move in their locked state and/or in their unlocked state when the control lever 12 is actuated. Therefore, in such alternative embodiments, rotation of the control lever 12 about the control lever pivot 18 in the locked or unlocked state is not necessarily exclusive (the control lever 12 can also pivot about a second point located a distance from the control lever pivot 18).

One having ordinary skill in the art will appreciate that the locked and unlocked positions described above can be reversed in other embodiments by changing the amount of second element rotation permitted in each direction past the center position 66.

The second element 52 is therefore operable to move the first element 50 into and out of a position in which the control lever 12 is incapable of exerting motive force or exerts insufficient motive force to trigger pawl release. The locking and unlocking mechanism 48 preferably has at least one stable position on either side of the center position 66 and at least one unstable position therebetween (at the center position 66). In some preferred embodiments such as the illustrated preferred embodiment, the locking and unlocking mechanism 48 has a range of stable positions on either or both sides of the center position 66 and an unstable position therebetween. The ranges of positions to either side of the center position 66 are stable because actuation of the control lever 12 urges the second element 52 to rotate away from the unstable position 66. In some highly preferred embodiments, these ranges of positions to either side of the center position 66 are also stable because the second element 52 is spring-biased toward stable positions on either side (and more preferably, both sides) of the center position 66.

The unstable positions are preferably divided by the "over center" position coinciding with line 66 described above so that actuation of the control lever 12 draws the locking and unlocking mechanism 48 toward one or the other stable position if not already there (e.g., biased under spring force). Specifically, and with reference to FIGS. 3–7, tension placed upon the first element 50 by actuation of the control lever 12 exerts force upon the rotatable second element 52 in one rotational direction or the other away from the center position 66.

It will be appreciated by one having ordinary skill in the art that the range of rotation of the second element 52 can vary significantly in different embodiments of the present invention. The amount of second element rotation in each direction past the center position of line 66 can also vary significantly. For example, the range of second element rotation in one direction past the line 66 can be any fraction of the range of second element rotation in an opposite direction past the line 66, depending at least partially upon the relative positions of the first element 50, second element 52, and the control lever 12. In the preferred embodiment illustrated in FIGS. 1–7 for example, the second element 52 is preferably free to rotate clockwise from the center position 66 to the stable unlocked position shown in FIGS. 3 and 4 until the pivot (not shown) upon which the second element 52 rotates is stopped as described above, and is preferably free to rotate through a larger range counter-clockwise from the center position 66 to the stable locked position shown in FIGS. 5 and 6.

As mentioned above, the locking and unlocking mechanism 48 illustrated in FIGS. 1–7 is preferably biased toward one of two stable positions on either side of the center position 66 indicated by dotted line 66. The locking and unlocking mechanism 48 can be biased toward a stable position in either direction, and more preferably is biased in both directions toward the stable end positions of the locking and unlocking mechanism 48. To achieve this over-center biasing, the second element 52 is preferably provided with a conventional over-center spring (not shown) which can be connected to the second element 52 in any conventional manner, such as by being connected directly to a face of the second element 52 or to the pivot upon which the second element 52 is rotatably mounted. The over-center spring can be a torsion spring operable and connected in a conventional manner, although other types of springs directly or indirectly connected to bias rotation of the second element 52 can be used to perform the same function, such as leaf springs, coil springs, and the like. Over-center springs and their manner of connection and operation are well known to those skilled in the art and are not therefore described further herein. In other embodiments, two or more over-center springs can be used (such as one over-center spring for biasing the locking and unlocking mechanism 48 toward a stable position in one direction and another over-center spring for biasing the locking and unlocking mechanism 48 toward a stable position in an opposite direction). Such alternatives for a single over-center spring are well known to those skilled in the art for application in any of the embodiments of the present invention described herein.

A number of alternative biasing elements and devices can be used to bias the locking and unlocking mechanism 48 into the stable position(s) as described above. Specifically, one or more elastic bands can be coupled to the locking and unlocking mechanism 48 and to the latch assembly housing 14 or other structure adjacent to the locking and unlocking mechanism 48 for biasing the locking and unlocking mechanism 48 as described above. Alternatively, biasing force can be supplied by one or more sets of electromagnets on the locking and unlocking mechanism 48 and on the latch assembly housing 14 or other structure adjacent to the locking and unlocking mechanism 48. Any other type of biasing element or device can be employed in still other embodiments of the present invention, including without limitation frictionally engagable and disengagable elements, one or more air springs, and the like.

In the embodiment illustrated in FIGS. 1–7, the orientation of the first and second elements 50, 52 with respect to one another at least partially defines the location of the center position for the locking and unlocking mechanism 48. The center position can also be defined by one or more biasing elements biasing the first and second elements toward either or both stable positions of the locking and unlocking mechanism 48 as described above. However, it should be noted that the rotational position of the second element 52 at which the biasing element(s) begin to exert force upon the locking and unlocking mechanism 48 toward the stable position(s) need not coincide with the center position 66 of the locking and unlocking mechanism 48. In other words, the "center" position of the biasing elements need not coincide with the center position 66 of the locking and unlocking mechanism 48. This is true not only of the first preferred embodiment illustrated in FIGS. 1–7, but also in the other embodiments of the present invention described in greater detail below.

Figure 6:
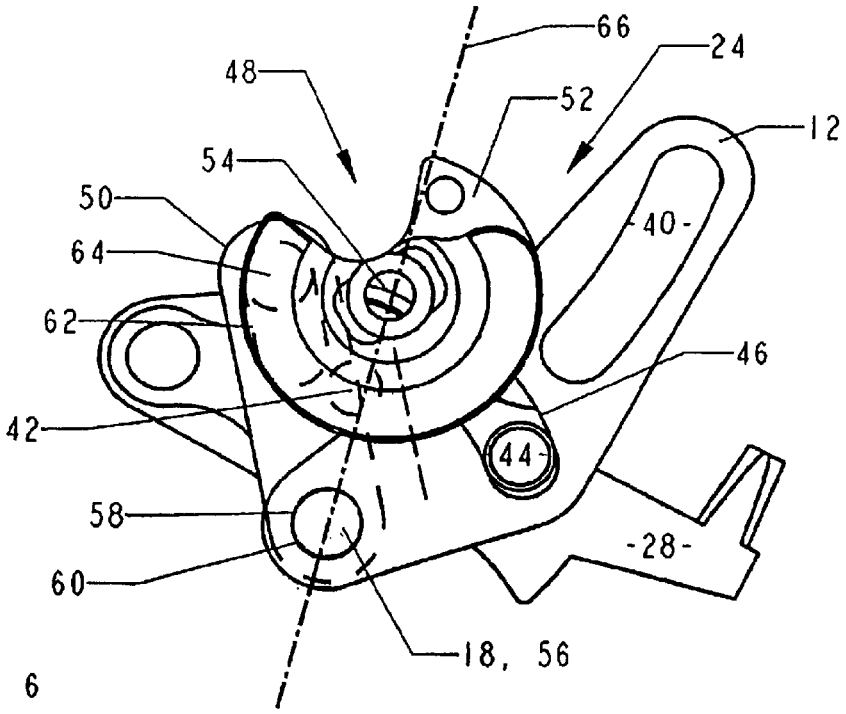
FIG. 6 is an elevational detail view of the latch assembly illustrated in FIG. 1, shown with the outside door handle mechanism in a locked and actuated state.
Figure 7:
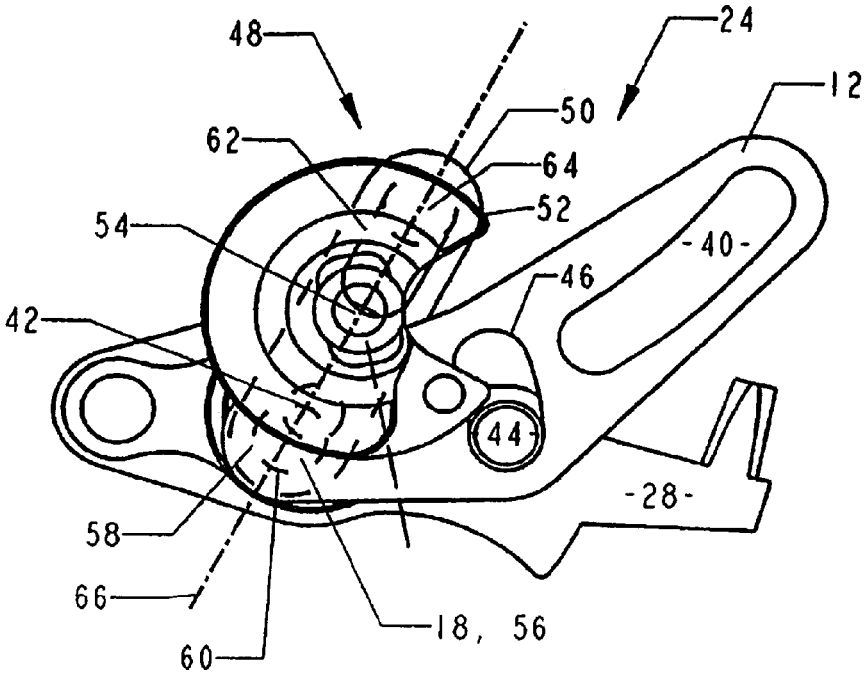
FIG. 7 is an elevational detail view of the latch assembly illustrated in FIG. 1, shown with the outside door handle mechanism in a center position.

By way of example only, and with reference to FIGS. 1 and 3–7 of the first preferred embodiment, a first spring can be coupled to the locking and unlocking mechanism 48 for urging rotation of the second element 52 in a clockwise direction to the stable position shown in FIGS. 3 and 4, and a second spring can be coupled to the locking and unlocking mechanism 48 for urging rotation of the second element 52 in a counter-clockwise direction to the stable position shown in FIGS. 5 and 6. These springs need not begin to exert force in their respective directions at the center line 66. Instead, the first spring can begin to exert a clockwise force when the pivot post 64 is located a distance to the left of the center line 66 as viewed in FIGS. 3–7. Alternatively or in addition, the second spring can begin to exert a counter-clockwise force when the pivot post 64 is located a distance to the right of the center line 66 as viewed in FIGS. 3–7. These forces are preferably not sufficient to move the locking and unlocking mechanism 48 over the center line 66, but can be desirable for smooth operation of the locking and unlocking mechanism 48. It should also be noted that the biasing element(s) coupled to the locking and unlocking mechanism 48 need not exert force through the entire range of mechanism motion from the center line 66 to the respective stable positions. Instead, the biasing element(s) can exert such forces in any part of these ranges of motion as desired.

With combined reference to FIGS. 3–7, it can be seen that the control lever 12 is pivotable about the same (or substantially the same) point with respect to the control lever 12 in both locked and unlocked positions of the control lever 12. In combination with the connection between the control lever 12 and the locking and unlocking mechanism 48, this feature facilitates a significant amount of control over the control lever 12, allowing the control lever 12 to be quickly, precisely, and repeatably positioned in a desired location with respect to the pawl 28. Also, by moving the control lever 12 and its associated pivot point with respect to the pawl 28, the control lever 12 can be removed from the pawl post 44 or other portion of the pawl 28 acted upon by the control lever 12 when the control lever 12 is in its locked state. Because the control lever 12 triggers pawl release, it is desirable in some applications to remove the control lever 12 or at least a part thereof a distance away from the pawl post 44. Specifically, all or part of the control lever 12 can be removed from the pawl post 44 so that the pawl post 44 is less likely to be subject to forces from the control lever 12 as a result of shock, impact, extreme vibration (such as by impact to the latch assembly 10, vehicle rollover, and the like), or tampering. It is therefore desirable in some embodiments of the present invention to remove the mass of the control lever 12 (or at least that portion of the control lever 12 that can act upon the pawl post 44) a distance from the pawl post 44. A clearance between the control lever 12 and the pawl post 44 when the control lever 12 is in an unlocked state is therefore preferred in some embodiments of the present invention.

The pivot point about which the control lever 12 can pivot is located at an end of the control lever 12 in the illustrated preferred embodiment of FIGS. 1–7. However, the pivot point of the control lever 12 can be located anywhere along the control lever 12 or can even be located at a point off of the control lever 12.

Figure 8:
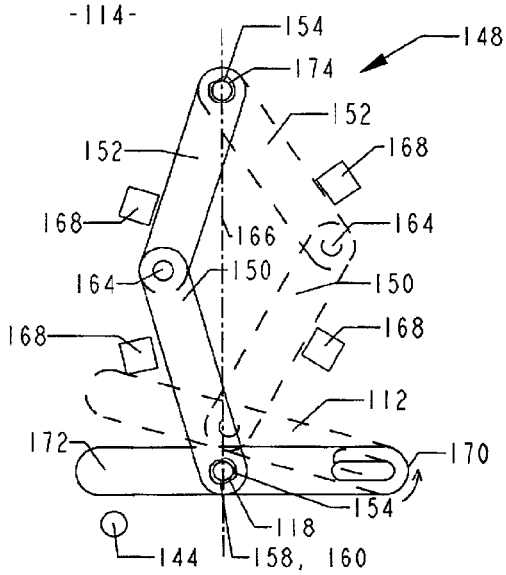
FIG. 8 is an elevational view of a door handle mechanism according to a second preferred embodiment of the present invention.
Figure 9:
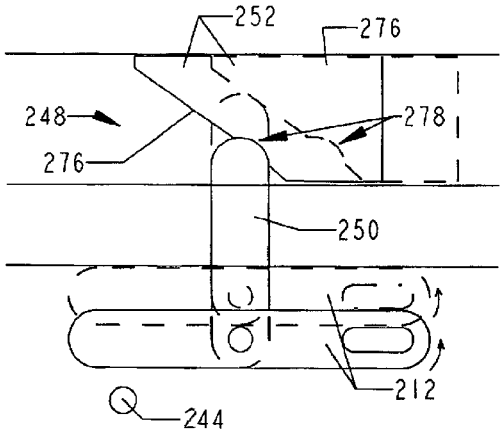
FIG. 9 is an elevational view of a door handle mechanism according to a third preferred embodiment of the present invention.
Figure 10:
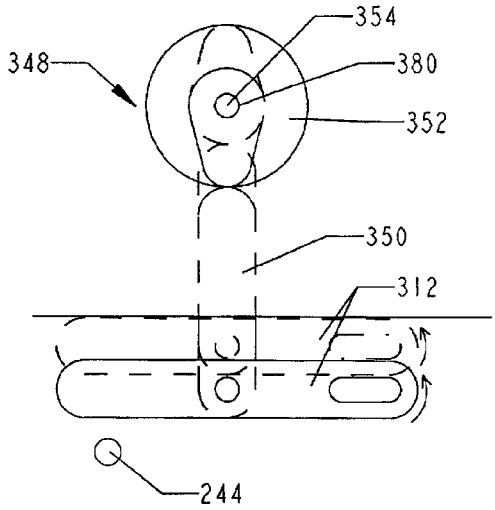
FIG. 10 is an elevational view of a door handle mechanism according to a fourth preferred embodiment of the present invention.

The locking and unlocking mechanism 48 illustrated in FIGS. 1 and 3–7 is only one of a number of devices and mechanisms that can be employed to move the control lever 12 with respect to the pawl 28. For example, the preferred embodiment illustrated in FIGS. 1–7 employs a locking and unlocking mechanism 48 that responds to tension (exerted by the control lever 12 upon the first element 50) in different ways depending upon the relative positions of the locking and unlocking mechanism 48. Other embodiments of the present invention employ locking and unlocking mechanisms that are subject to compression rather than tension when the control lever 12 is actuated. Three such mechanisms are illustrated in FIGS. 8–10. The three locking and unlocking mechanisms illustrated in FIGS. 8–10 represent alternatives to the locking and unlocking mechanism 48 illustrated in FIGS. 1 and 2–6. Each of the locking and unlocking mechanisms illustrated in FIGS. 8–10 is an over-center device. As mentioned above, the locking and unlocking mechanism need not necessarily be an over-center device, although such devices are preferred.

With reference first to FIG. 8, the locking and unlocking mechanism 148 illustrated therein is another over-center device. The locking and unlocking mechanism 148 preferably has a first link 150 and a second link 152 articulated together by a common pivot 164. Each of the links 150, 152 is preferably pivotable about another respective pivot 118, 154 located a distance from the common pivot 164. The first link 150 is preferably pivotably connected to the control lever 112 while the second link 152 is pivotably connected to a wall 114 of the latch assembly 110.

Like the other embodiments of the present invention described herein, the first and second links 150, 152 of the embodiment shown in FIG. 8 can instead take any shape or form desired. Likewise, the relative sizes and dimensions of the links 150, 152 can be in any proportion desired and suitable for a particular application.

In the preferred embodiment illustrated in FIG. 8, the first link 150 and the control lever 112 each have a respective aperture 158, 160 through which extends a pivot pin 154. The first link 150 and the control lever 112 can be connected in any of the manners described above with reference to the first preferred embodiment of the present invention.

One having ordinary skill in the art will appreciate that the first link 150 can be pivotably connected to the control lever 112 in a number of different manners permitting relative rotation between the first link 150 and the control lever 112, each one of which falls within the spirit and scope of the present invention. Similarly, one having ordinary skill in the art will appreciate that the second link 152 can be mounted for pivotal movement within the latch assembly 110 in a number of different manners each also falling within the spirit and scope of the present invention.

By virtue of the common pivot 164 and the pivotable connection of the links 150, 152 to the outside handle control lever 112 and the latch assembly wall 114, the links 150, 152 can assume a number of different rotational positions relative to one another. The locking and unlocking mechanism 148 therefore at least has a locked position and an unlocked position. In the unlocked position (shown in solid lines in FIG. 8), the links 150, 152 are positioned at a slight angle with respect to one another and to one side of a line 166 passing through the dedicated linkage pivots 118, 154. In the locked position (shown in dotted lines in FIG. 8), the links 150, 152 are positioned at an angle with respect to one another and to another side of the line 166 passing through the dedicated linkage pivots 118, 154.

In their unlocked position to one side of the line 166, the links 150, 152 are capable of resisting force exerted by the control lever 112, and transmit such force from the first link 150 through the common pivot 164 and second link 152 and to the pivot 154 of the second link 152 (or to an element connected to the second link 152 if the linkage pivot 154 of the second link 152 is attached to such an element). When the links 150, 152 are in their locked position to the other side of the line 166, the links 150, 152 are incapable of resisting such force from the control lever 112.

When the control lever 112 is pivoted by an actuation force as described above, the control lever 112 pivots about or near the pivot 118 which is preferably held substantially in place by the links 150, 152 in their unlocked position shown in solid lines in FIG. 8. Force transmitted by actuation of the control lever 112 (a lifting direction at the right-hand end of the control lever 112 in FIG. 8) is transmitted from the pivot 118 in an upward direction to the links 150, 152. In their unlocked positions, the links 150, 152 are preferably prevented from pivoting farther away from the line 166 running through the dedicated linkage pivots 118, 154 by one or more stops 168 on the latch assembly wall 114. The stops 168 limit the amount of movement of the locking and unlocking mechanism 148 in one direction away from the line 166. The stops 168 are preferably posts, blocks, walls, or other protrusions extending from the latch assembly wall 114, but can instead be elements connected to the latch assembly wall 114 or other stationary structure of the latch assembly 110 adjacent to the locking and unlocking mechanism 148.

One having ordinary skill in the art will appreciate that the links 150, 152 can be prevented from over-rotating in their unlocked positions (i.e., in a direction farther away from the line 166) in any number of different manners. By way of example only, the stops 168 can be located in a number of other positions adjacent to either link 150, 152 to still prevent linkage over-rotation away from the line 166 in the unlocked position. As another example, any of the three pivots 164, 118, 154 can have a limited rotational range which prevents further rotation of the connected links 150, 152 once an unlocked position has been reached such as that shown in solid lines in FIG. 8. Pivots having a limited rotational range and for limiting the rotational range of connected elements are conventional in structure and operation and are not therefore described further herein. As another example, the common pivot 164 can be received within a groove, slot, or other aperture in an adjacent wall 114 of the latch assembly housing (not shown) which defines a limit to which the common pivot 164 (and therefore the links 150, 152) can move away from the line 166 in the unlocked position. As yet another example, either or both links 150, 152 can have one or more posts, fingers, walls, or other elements extending therefrom into recesses, slots, grooves, holes, or other apertures in a wall 114 of the latch assembly housing. The aperture(s) can thereby limit the range of linkage motion past the line 166 in much the same way as the common pivot 164 and aperture embodiment just described. Alternatively, an element can extend from a wall 114 of the latch assembly housing to an aperture in either link 150, 152 to perform the same function. Still other manners of limiting linkage motion past the line 166 in the unlocked position are possible and fall within the spirit and scope of the present invention.

As described above, when the links 150, 152 are in the unlocked position to one side of the line 166 running through the dedicated linkage pivots 118, 154, the links 150, 152 can resist motion of the control lever 112 by resisting movement of the pivot 118. Therefore, actuation of one end 170 of the control lever 112 (when the links 150, 152 are in their unlocked position) causes the control lever 112 to pivot about or near the pivot 118, which acts as a fulcrum so that the opposite end 172 of the control lever 112 acts upon the pawl post 144 and releases the pawl 128.

When the links 150, 152 are moved to the locked position on the opposite side of the line 166 through the dedicated linkage pivots 118, 154, the control lever 112 is moved away from the pawl 128. Although not required, the control lever 112 preferably remains pivotable about the same point with respect to the control lever 112 (i.e., the control lever pivot 118 in the embodiment shown in FIG. 8). In the locked position of the links 150, 152, actuation of the control lever 112 preferably causes the control lever 112 to pivot about the control lever pivot 118. Therefore, actuation of one end 170 of the control lever 112 (when the links 150, 152 are in their locked position) causes the control lever 112 to pivot about or near the control lever pivot 118 without exerting any force or sufficient force upon the pawl post 144 to move and release the pawl 128. The locked position of the links 150, 152 is shown in dotted lines in FIG. 8.

In some highly preferred embodiments, the first and second links 150, 152 do not move or do not move significantly when the control lever 112 is actuated in either the locked state or the unlocked state of the locking and unlocking mechanism 148. However, in other embodiments, both links 150, 152 are free to move in their locked or unlocked state when the control lever 112 is actuated. Therefore, in such alternative embodiments, rotation of the control lever 112 about the control lever pivot 118 in the locked state is not exclusive (the control lever 112 also pivots about a second point located a distance from the control lever pivot 118).

Although the present invention can operate without any bias placed upon the outside handle locking and unlocking mechanism 148, this mechanism 148 is more preferably biased into either of its locked and unlocked positions and is most preferably biased into both positions as will be described below. Specifically, when the links 150, 152 have been rotated so that the common pivot 164 is on one side of the line 166 running through the dedicated linkage pivots 118, 154, actuation of the control lever 112 will preferably only force the links 150, 152 in a direction away from the line 166. Therefore, the locking and unlocking mechanism 148 is operable to lock and unlock the control lever 112 without being biased by any additional elements or structure. However, some preferred embodiments of the present invention have one or more biasing elements directly or indirectly coupled to the links 150, 152 to bias them into either or both locked and unlocked positions.

The biasing elements can be torsion springs 174 connected to the dedicated linkage pivots 118, 154 and/or to the common pivot 164 in any conventional manner to exert a rotational force upon the links 150, 152 toward the stable positions on either side of the center position of the locking and unlocking mechanism 148. Alternatively, the links 150, 152 can be biased toward either or both stable positions by one or more springs connected to a wall 114 of the latch assembly housing (not shown) and to either or both links 150, 152, by one or more magnet sets connected to the links 150, 152 and to the latch assembly wall 114 (e.g., opposed magnets on the links 150, 152 and on the latch assembly wall 114 at the line 166 running through the dedicated linkage pivots 118, 154, attracting magnets on the links 150, 152 and on either side of the line 166, etc.), and the like. In any case, where the locking and unlocking mechanism 148 employs a biasing element or mechanism biasing the links 150, 152 into locked and/or unlocked positions, the biasing element or mechanism biases the links 150, 152 in a direction toward the stable positions of the locking and unlocking mechanism 148. In the illustrated preferred embodiment for example, the links 150, 152 can be biased toward the unlocked position shown in solid lines in FIG. 8 when the common pivot 164 has crossed the line 166 in a direction toward the unlocked position (although the biasing force can be applied before or after crossing the line 166 as described in greater detail above with regard to the first preferred embodiment). Similarly, the links 150, 152 can be biased toward the locked position shown in dotted lines in FIG. 8 after, before, or as the common pivot 164 has crossed the line 166 in a direction toward the locked position.

In some alternative embodiments of the present invention, the links 150, 152 are not biased into both locked and unlocked positions, but are instead biased into one of these positions. In such cases, the links 150, 152 are preferably rotated toward the biased direction until acted upon by the biasing element(s), after which time the links 150, 152 preferably continue their rotation to a desired position under biasing force. When the links 150, 152 have been rotated sufficiently in an opposite direction, the links 150, 152 can remain in their position until actuated and are preferably not biased back toward and across the line 166.

The unlocked and locked positions of the locking and unlocking mechanism 148 described above and illustrated in the figures is to the left and right of the line 166 passing through the dedicated linkage pivots 150, 152. However, the operational principles of the locking and unlocking mechanism 148 according to the present invention are not limited to or defined by the particular orientation of the locking and unlocking mechanism 148. This mechanism can be oriented in any manner desired based at least in part upon the particular latch application at hand and the positions and orientations of control levers in the latch assembly. Also, the angle between the links 150, 152 in their locked and unlocked positions can be different than those shown in FIG. 8. The angle between the links 150, 152 facing the line 166 in each position is at least less than 180 degrees when the control lever 112 is not actuated.

In operation, one or both links 150, 152 of the locking and unlocking mechanism 148 are preferably actuated to pivot about the common pivot 164 and to move the common pivot 164 across the line 166 running through the dedicated linkage pivots 118, 154. For example, when the common pivot 164 in the illustrated preferred embodiment of FIG. 8 is moved to the right across the center line 166, the locking and unlocking mechanism 148 is placed in its locked state. Specifically, when the control lever 112 is actuated as described above (rotated counterclockwise as shown by the arrow in FIG. 8), the control lever 112 pivots about the control lever pivot 118 without imparting force or sufficient force to the pawl post 144 to release the pawl 128. Because the links 150, 152 are preferably biased into the locked position, forces from vibration, shock, repeated control lever actuation, and other sources will not cause the locking and unlocking mechanism 148 to slip from its locked position.

When the common pivot 164 in the illustrated preferred embodiment of FIG. 8 is moved to the left across the center line 166, the locking and unlocking mechanism 148 is placed in its unlocked state. Specifically, when the control lever 112 is actuated as described above (rotated counterclockwise as shown by the arrow in FIG. 8), the links 150, 152 preferably abut the stops 168 and are prevented from pivoting further about the common pivot 164. The links 150, 152 therefore hold the control lever pivot 118 in place or at least from substantial movement. The control lever 112 pivots about or near this pivot 118 and forces the pawl post 144 to move sufficiently to release the pawl 128. Because the links 150, 152 are preferably biased into the unlocked position, forces from vibration, shock, repeated control lever actuation, and other sources will not cause the locking and unlocking mechanism 148 to slip from its unlocked position.

It will be appreciated by one having ordinary skill in the art that the latch inputs for moving the links 150, 152 between their locked and unlocked states can take any number of different forms. For example, either link 150, 152 can be directly or indirectly connected to an output shaft of a motor, a plunger rod, a cable, a link, or any other element or mechanism connected to a locking and unlocking input (such as a cylinder lock, a sill button, a locking lever, electronic lock controls, and the like).

The locking and unlocking mechanism 148 illustrated in FIG. 8 is another example of a mechanism that can be used to move the control lever 112 with respect to the pawl 128. As mentioned above, in some preferred embodiments the control lever 112 is pivotable about the same point with respect to the control lever 112 (e.g., control lever pivot 18 in the first preferred embodiment and control lever pivot 118 in the second preferred embodiment) in both locked and unlocked states. It should be noted that in each embodiment of the present invention employing such a control lever, the control lever can pivot about the same point with respect to the control lever in any state of the locking and unlocking mechanism. Specifically, the control lever in some embodiments is always pivotable about the same location with respect to the control lever regardless of the position and orientation of the locking and unlocking mechanism. In other embodiments, the control lever is pivotable about the same location with respect to the control lever only in fully locked and unlocked states of the locking and unlocking mechanism. When in transition between these states, the control lever can be pivotable about one or more other pivot locations with respect to the control lever.

In those embodiments of the present invention in which the control lever is pivotable about the same point with respect to the control lever in both locked and unlocked states, the control lever need not rotate exclusively about the subject point. In some embodiments, the control lever can also pivot simultaneously about another point in either state.

Still other elements and mechanisms exist for moving the control lever 12, 112 with respect to the pawl 28, 128 while (in some preferred embodiments) keeping the pivot point of the control lever 12, 112 in the same location with respect to the control lever 12, 112. Although not required in some embodiments of the present invention, over-center devices are preferred. Two additional examples of such mechanisms are illustrated in FIGS. 9 and 10. Like the locking and unlocking mechanisms of the first and second preferred embodiments described above, these alternative mechanisms preferably have a stable locked position and a stable unlocked position from which the mechanism will not shift even under significant vibration, repeated input actuation, and harsh operating conditions. Also like the earlier-described locking and unlocking mechanisms, each of these alternative mechanisms are preferably biased into these stable positions by one or more biasing elements (such as springs, magnets, and the like).

With reference first to the locking and unlocking mechanism of FIG. 9, a first element 250 is positioned relative to a second element 252 for engagement therewith. The second element 252 of the locking and unlocking mechanism 248 has a ramped surface 276 and is movable with respect to the first element 250 of the locking and unlocking mechanism 248. The second element 252 can take any shape having a ramped surface 276, such as a wedge shape as shown in FIG. 9. The first element 250 is preferably biased in a direction toward the second element 252 by one or more springs (not shown) connected to or otherwise positioned to exert force against the first element 250 or the control lever 212. Alternatively, the first element 250 can be biased toward the second element by one or more electro-magnet sets (on the first and second elements 250, 252, on the first element 250 and in a position adjacent to the second element 252, and the like.

When the first and second elements 250, 252 are relatively positioned so that the first element 250 is biased against the ramped surface 276 of the second element 252, the second element 252 preferably moves to the right as shown in FIG. 9 under biasing force from the first element 250 against the ramped surface 276. The first and second elements 250, 252 therefore have a stable position in which the first element 250 is at the "bottom" of the ramped surface 276. The second element 252 also preferably has a recess 278 at the "top" of the ramped surface 276 for receiving the first element 250 when the second element 252 has been actuated until the recess 278 is aligned with the first element 250. When thus aligned, the first element 250 preferably engages with the second element 252 and thereby secures the second element 252 in place with respect to the first element 250. This defines a second stable position of the elements 250, 252. Although a recess 278 in the second element 252 is preferred, a number of other surface features also provide a stable position of the second element 252 relative to the first element 250 at the "top" of the ramped surface 276, including without limitation a slot, dimple, aperture, step, plateau, groove, and the like in the second element 252.

As with the locking and unlocking mechanisms 48, 148 of the two illustrated preferred embodiments described above, the two stable positions of the elements 250, 252 are separated by at least one intermediate unstable position. The first element 250 can be connected to the control lever 212 to move the control lever 212 with respect to the pawl post 244 and to thereby place the control lever 212 in locked and unlocked states (wherein actuation such as rotation of the control lever 212 as shown by the arrows in FIG. 9 is incapable and capable of sufficiently moving the pawl post 244 to release the ratchet, respectively).

The third preferred embodiment of the present invention illustrated in FIG. 9 also provides an example of how the control lever 212 can be moved by the locking and unlocking mechanism 248 in different manners with respect to the pawl 228. In the third preferred embodiment, the control lever 212 is translatable with respect to the pawl 228 between a position adjacent to the pawl post 244 and a position removed from the pawl post 244. In the first two embodiments described above and illustrated in FIGS. 1–8, the control lever 12, 112 is rotatable between such positions or is movable between such positions by a combination of rotation and translation. It should be noted that the control lever of the present invention can move with respect to the pawl in any manner desired. Any type of movement capable of positioning the control lever in an unlocked position (in which the control lever can be actuated to move the pawl and release the ratchet) and in a locked position (in which the control lever is incapable of moving or sufficiently moving the pawl to release the ratchet) can be employed.

The alternative embodiment of the present invention illustrated in FIG. 10 functions in a similar manner to the FIG. 9 embodiment described above. Rather than employ an element having a ramped surface such as that of the second element 252, the locking and unlocking mechanism 348 preferably includes a second element 352 mounted to rotate about an axis 354 adjacent to the first element 350. The second element 352 is preferably eccentric with respect to the axis 354, is lobed, or is otherwise shaped so that all or a portion of the second element 352 moves toward and away from the first element 350 when the second element 352 is rotated about the axis 354. The rotating second element 352 can have a first stable position in which the second element 352 is rotated away from the first element 350 and can be biased into another stable position (e.g., rotated toward the first element 350) by one or more biasing elements. For example, the second element 352 can be mounted upon a pivot 380 having a conventional spring thereon biasing the second element 352 toward the first element 350.

Therefore, the second element 352 is normally biased into a stable position rotated toward the first element 350, but has another stable position rotated away from the first element 350 and preferably retained therein under biasing force from the second element 352. As another example, the second element 352 can have a recess or other surface feature (similar to that described above with reference to the second element 252 in the FIG. 9 embodiment) preferably aligned with the first element 350 when the second element 352 is rotated toward the first element 350. The first element 350 engages with the recess of the second element 352 to define a second stable position of the locking and unlocking mechanism 348.

As with the locking and unlocking mechanisms 48, 148, 248 of the illustrated preferred embodiments described above, the two stable positions of the elements 350, 352 are separated by at least one intermediate unstable position. The first element 350 can be connected to the control lever 312 to move the control lever 312 with respect to the pawl post 344 and to thereby place the control lever 312 in locked and unlocked states (wherein actuation such as rotation of the control lever 212 as shown by the arrows in FIG. 9 is incapable and capable of sufficiently moving the pawl post 244 to release the ratchet, respectively).

It should be noted that the particular type of locking and unlocking mechanism employed (whether an over-center device or not) is independent of the type(s) of force exerted by and upon the locking and unlocking mechanism and its elements when the control lever 12, 112, 212, 312 is actuated. For example, the locking and unlocking mechanism 348 of the fourth preferred embodiment illustrated in FIG. 10 could potentially be placed in a state where actuation of the control lever 312 places the elements 350, 352 in almost complete compression. In contrast, the locking and unlocking mechanism 148 of the second preferred embodiment illustrated in FIG. 8 can experience a combination of forces when in the unlocked state. These forces can include rotational and compressive forces with little to no tensile forces. In yet another example as shown in FIGS. 1–7, the first element 50 of the locking and unlocking mechanism 48 can experience forces that are mostly or all tensile. Other types of locking and unlocking mechanisms fall within the spirit and scope of the present invention, and can experience any combination of tensile, compressive, and moment forces in reaction to control lever actuation in either or both locked and unlocked states of such mechanisms.

Each of the illustrated preferred embodiments described above has a control lever 12, 112, 212, 312 which is pivotable about the same location with respect to the control lever 12, 112, 212, 312 in both locked and unlocked states of the control lever 12, 112, 212, 312. Although this feature is preferred in the various illustrated embodiments, it is not a required feature for other embodiments of the present invention. For example, some embodiments of the present invention employ the over-center locking and unlocking mechanisms, yet have a control lever that pivots about different locations with respect to the control lever when in a locked state and in an unlocked state. In other words, the over-center locking and unlocking mechanism of the present invention can be employed with control levers that are movable in any manner.

By way of example only, an alternative embodiment of the locking and unlocking mechanism 48 of FIGS. 1–7 is illustrated in FIGS. 11–14 (elements and features of the embodiment shown in FIGS. 11–14 corresponding to those of the embodiment shown in FIGS. 1–7 have corresponding reference numerals in the 400 series). In this embodiment, the locking and unlocking mechanism 448 is an over-center device, but is not biased by a spring or other biasing device into fully-rotated locked and unlocked positions as described above. Instead, actuation of the control lever 412 draws the first element 450 and the pivot post 464 to the side of the center line 466 on which the pivot post 464 is already located. Further actuation of the control lever 412 preferably draws the pivot post 464 and the second element 452 around the axis 454. Therefore, the control lever 412 can be placed in its locked and unlocked states by directly or indirectly rotating the pivot post 464 to one side or the other of center line 466 (without necessarily rotating or biasing the pivot post 464 to any particular position past the center line 466). If not already rotated to a stopped position as described above, subsequent actuation of the control lever 412 will rotate the second element 452 further in the same direction.

Figure 11:
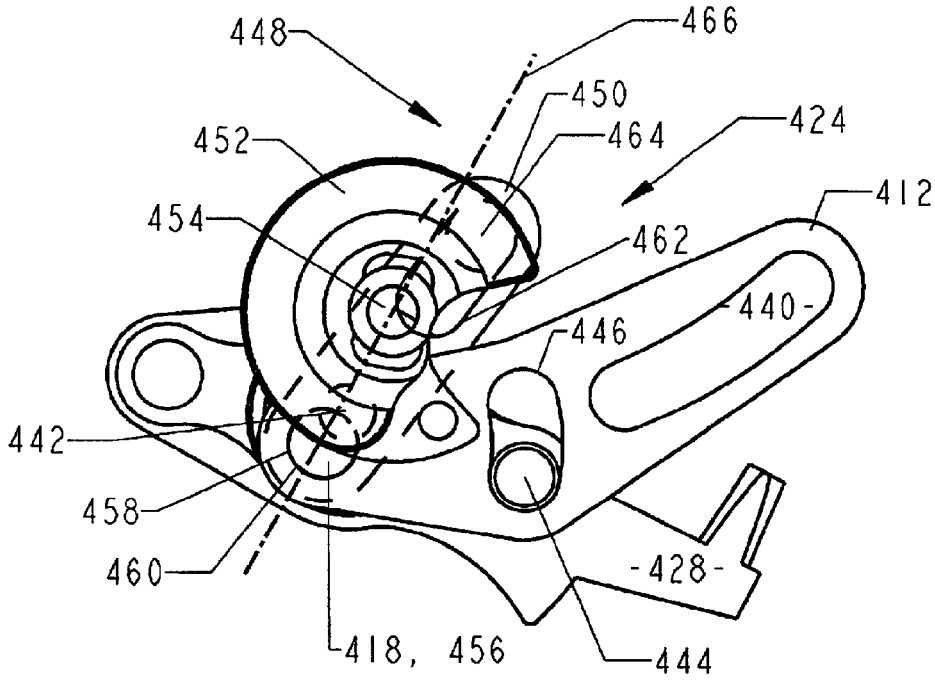
FIG. 11 is an elevational view of a door handle mechanism according to a fifth preferred embodiment of the present invention, shown with the door handle mechanism in an unlocked and unactuated state.
Figure 12:
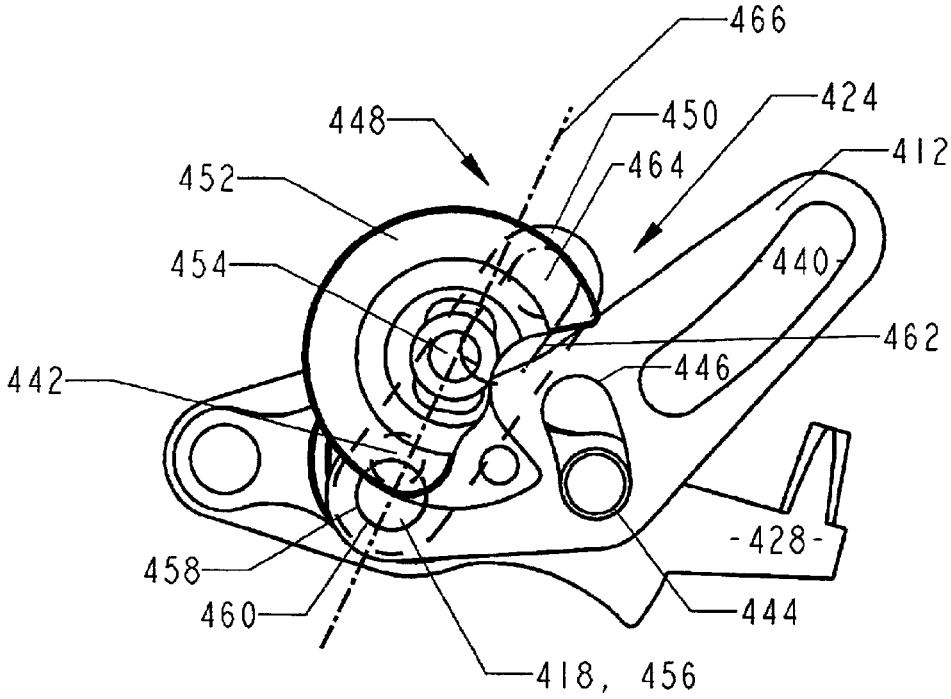
FIG. 12 is an elevational view of the door handle mechanism illustrated in FIG. 11, shown with the door handle mechanism in an unlocked and actuated state.
Figure 13:
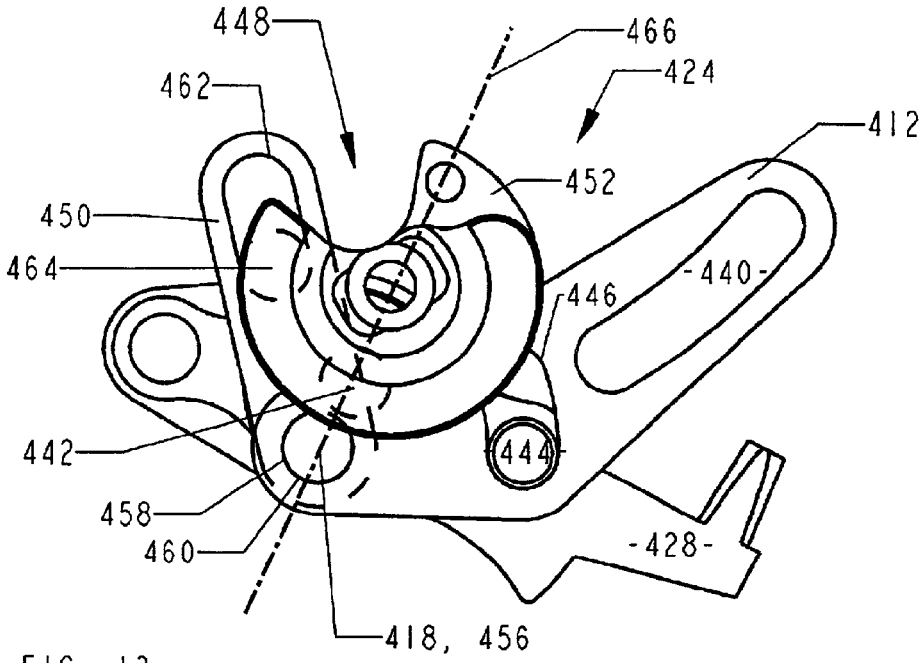
FIG. 13 is an elevational view of the door handle mechanism illustrated in FIG. 11, shown with the door handle mechanism in a locked and unactuated state.
Figure 14:
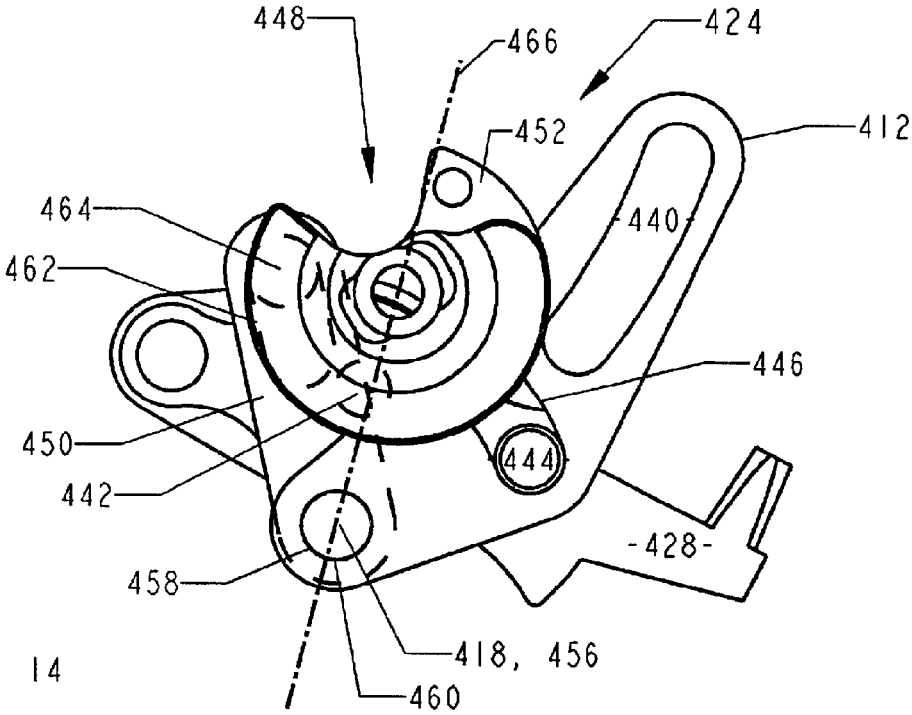
FIG. 14 is an elevational view of the door handle mechanism illustrated in FIG. 11, shown with the door handle mechanism in a locked and actuated state.

With reference to FIG. 11, when the second element 452 is rotated to the right side of the center line 466, the control lever 412 is in its unlocked position as described above. However, subsequent actuation of the control lever 412 as shown in FIG. 12 causes the first element 450 to rotate the second element 452 clockwise. Preferably, rotation of the second element 452 is limited in this direction as described in greater detail with reference to the first preferred embodiment illustrated in FIGS. 1–7. Therefore, the control lever 412 preferably pivots about the pawl post 444 rather than about the control lever pivot 418 until the second element 452 is stopped. Further actuation of the control lever 412 rotates the control lever 412 about the control lever pivot 418 while the control lever 412 moves the pawl post 44 to release the pawl 428 (see FIG. 12). With reference to FIG. 13, when the second element 452 is rotated to the left side of the center line 466, the control lever 412 is in its locked position as described above. However, subsequent actuation of the control lever 412 as shown in FIG. 14 causes the first element 450 to rotate the second element 452 counter-clockwise. Preferably, rotation of the second element 452 is not limited in this direction (such as by one or more stops). Therefore, the control lever 412 preferably pivots about the pawl post 444 rather than about the control lever pivot 418 as shown in FIG. 14. This motion imparts no motive force to the pawl 428, or at least insufficient motion to trigger pawl release.

By operating in the manner just described, the control lever 412 pivots about different points in the locked and unlocked states of the control lever 412 (i.e., about the control lever pivot 418 in the locked state and about the pawl post 444 and control lever pivot 418 in the unlocked state). The embodiment of the present invention illustrated in FIGS. 11–14 is an example of the manner in which the over-center locking and unlocking mechanism of the present invention can be employed to control the motion of control levers in different latch assembly arrangements.

Figure 15:
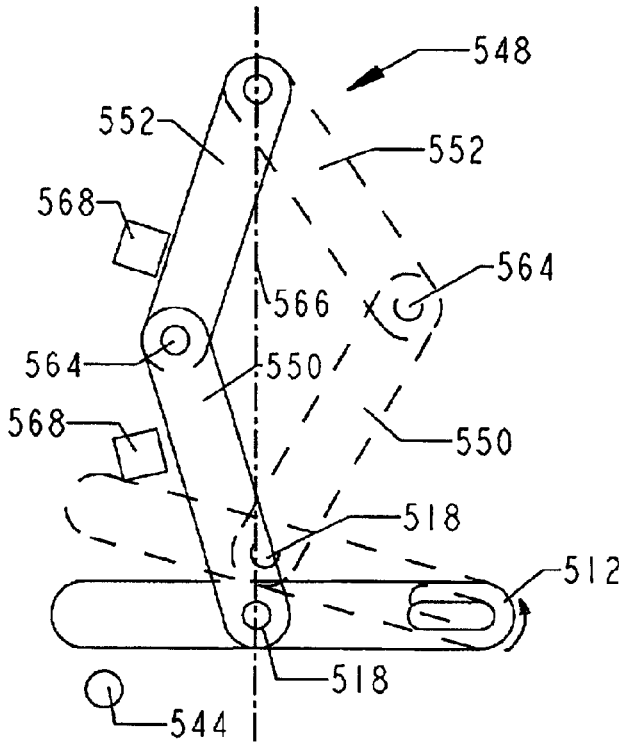
FIG. 15 is an elevational view of a door handle mechanism according to a sixth preferred embodiment of the present invention.

As another example, an alternative embodiment of the locking and unlocking mechanism 48 of FIG. 8 is illustrated in FIG. 15 (elements and features of the FIG. 8 embodiment corresponding to those of the embodiment shown in FIG. 15 have corresponding reference numerals in the 500 series). In the FIG. 15 embodiment, the locking and unlocking mechanism 548 is an over-center device, but is not biased by a spring or other biasing device into fully-rotated locked and unlocked position as described above. Instead, actuation of the control lever 512 draws the common pivot 564 to the side of the center line 566 on which the common pivot 564 is already located. Further actuation of the control lever 512 preferably draws the common pivot 564 and the links 550, 552 into the same direction away from the center line 566. Therefore, the control lever 512 can be placed in its locked and unlocked states by directly or indirectly moving the common pivot 564 to one side or the other of center line 566 (without necessarily moving or biasing the pivot post 464 and links 550, 552 to any particular positions past the center line 566). If not already rotated to a stopped position as described above, subsequent actuation of the control lever 512 will rotate the first and second links 550, 552 further in the same direction.

With continued reference to FIG. 15, when the common pivot 564 is moved to the right side of the center line 566, the control lever 512 is in its locked position as described above. Subsequent actuation of the control lever 512 causes the first and second links 550, 552 to continue pivoting away from the center line 566. Preferably, rotation of the first and second links 550, 552 is not limited in this direction (such as by one or more stops). Therefore, the control lever 512 preferably pivots about a location closer to or adjacent to the pawl post 544 rather than about the control lever pivot 518. This motion imparts no motive force to the pawl 528, or at least insufficient motion to trigger pawl release. When the common pivot 564 is moved to the left side of the center line 566, the control lever 512 is in its unlocked position as described above. Subsequent actuation of the control lever 512 causes the first and second links 550, 552 to continue pivoting away from the center line 566. Preferably, rotation of the first and second links 550, 552 is limited in this direction as described in greater detail with reference to the second preferred embodiment illustrated in FIG. 8. Therefore, the control lever 512 preferably pivots closer to or near the pawl post 544 rather than about the control lever pivot 518 until the first and second links 550, 552 are stopped. Further actuation of the control lever 512 rotates the control lever 512 about the control lever pivot 518 while the control lever 512 moves the pawl post 544 to release the pawl 528.

By operating in the manner just described, the control lever 512 pivots about different points in the locked and unlocked states of the control lever 512. The FIG. 15 embodiment is another example of the manner in which the over-center locking and unlocking mechanism of the present invention can be employed to control the motion of control levers in different latch assembly arrangements. It should be noted that the control levers 412, 512 of the embodiments illustrated in FIGS. 11–15 need not necessarily pivot about one point in any given range of motion of the control levers 412, 512. One having ordinary skill in the art will appreciate that the control levers 412, 512 in these and other embodiments can simultaneously pivot about two different points and/or can pivot about a point that moves with respect to the control lever 412, 512 or with respect to the pawl 428, 528 as the control lever 412, 512 is actuated. The over-center device of the present invention can be employed to control the motion of control levers moving in any of these manners.

In some applications of the present invention, it may be desirable or necessary to locate the control lever of the latch assembly a distance from the pawl. In such applications, the control lever can be connected to the pawl by one or more links, rods, or other elements capable of transmitting force from the control lever to the pawl. Such embodiments preferably operate in a manner similar to the latch assemblies illustrated in FIGS. 1–15. An example of such an embodiment is illustrated in FIGS. 16–19. The latch assembly 610 in FIGS. 16–19 is similar in a number of manners to that of FIGS. 1–7. Elements and features of the embodiment shown in FIGS. 16–19 corresponding to those of the embodiment shown in FIGS. 1–7 have corresponding reference numerals in the 600 series.

In this embodiment, the control lever 612 is not directly connected to the pawl 628, but is instead connected thereto by a link 682. Although illustrated as an elongated member connected at opposite ends to the control lever 612 and pawl 628, respectively, the link 682 can have any shape desired.

Preferably, the link 682 is rotatably connected to the control lever 612 and to the pawl 628, with at least one of these connections being a lost-motion connection. The link 682 can be rotatably connected to the control lever 612 by a pivot 684, and can be rotatably connected to a pawl post 644 received within an elongated aperture 646 in the link 682. The connection between the link 682 and the pawl 628 is preferably similar in nature to the connection between the control lever 12 and pawl 28 described above, and can take other forms as described in greater detail with reference to the first preferred embodiment illustrated in FIGS. 1–7.

FIGS. 16–19 illustrates another example of a locking an unlocking mechanism according to the present invention. The locking and unlocking mechanism (indicated generally at 648) is preferably similar to that of the first preferred embodiment illustrated in FIGS. 1–7, and has first and second elements 650, 652, a pivot post 664 connecting the first and second element 650, 652, a control lever pivot 618, and a center position 666 as described above with reference to the first preferred embodiment. Preferably, neither of the connections between the first and second elements 650, 652 and between the first element 650 and the control lever 612 are lost-motion connections, although either or both connections can be lost-motion connections if desired.

The locking and unlocking mechanism 648 is another example of an over-center device used to position the control lever 612 with respect to the pawl 628. In contrast to some of the over-center devices 48, 448 described above, the locking and unlocking mechanism is placed generally in compression when the control lever 612 is actuated. However, other locking and unlocking mechanisms (whether over-center or otherwise) as described herein can be employed.

Figure 16:
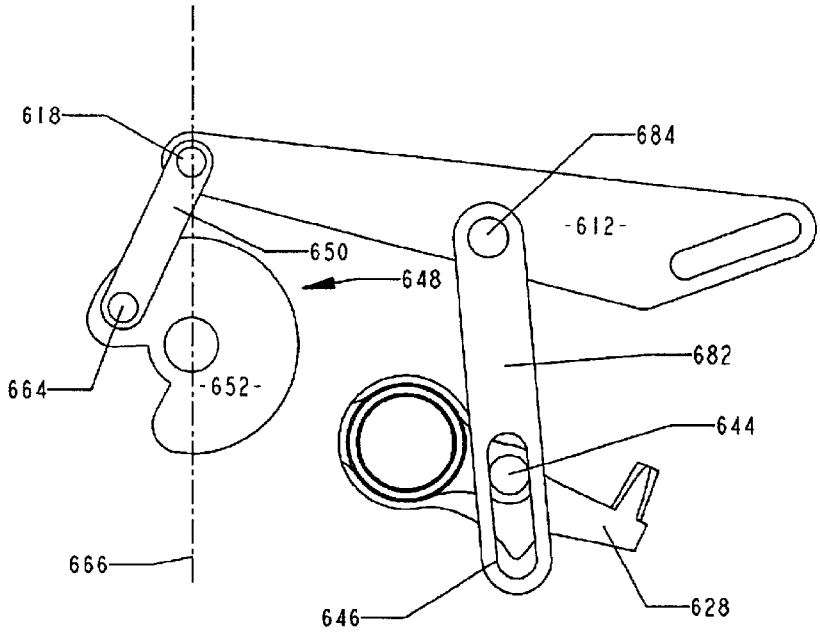
FIG. 16 is an elevational view of a door handle mechanism according to a seventh preferred embodiment of the present invention, shown with the door handle mechanism in a locked and unactuated state.
Figure 17:
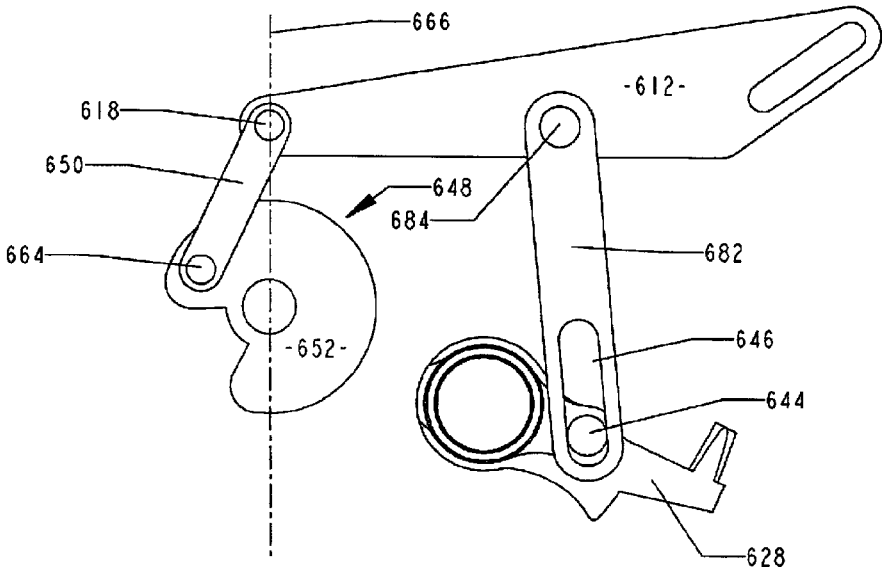
FIG. 17 is an elevational view of the door handle mechanism illustrated in FIG. 16, shown with the door handle mechanism in a locked and actuated state.

With the exceptions described below, the locking and unlocking mechanism 648 preferably operates in a manner similar to the locking and unlocking mechanism illustrated in FIGS. 1–7. With reference to FIG. 16, the second element 652 can be rotated in one direction (counter-clockwise as viewed in FIGS. 16–19) to move the pivot post 664 to one side of the center position 666 of the second element 652. The second element 652 preferably rotates until stopped by one or more stops (not shown). As shown in FIG. 17, the control lever 612 in this position is incapable of moving the pawl 628 due to the lost-motion connection with the pawl 628 as described above. Specifically, subsequent actuation of the control lever 612 causes the control lever 612 to pivot about the control lever pivot 612, whereby force is transferred through the first element 650 to the stopped second element 652 while the link 682 moves with respect to the pawl 628. Therefore, the control lever 612 is locked in this state.

Figure 18:
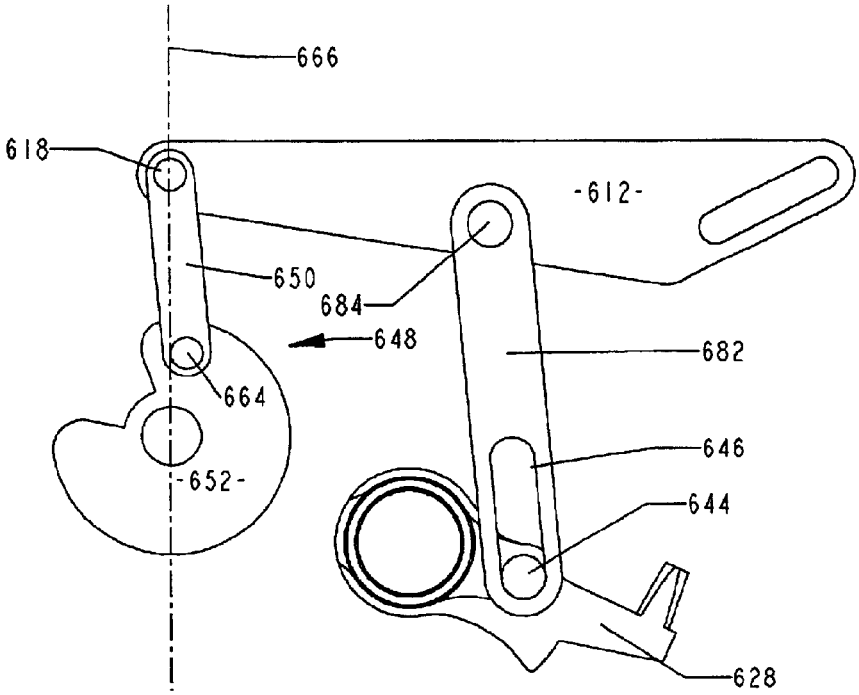
FIG. 18 is an elevational view of the door handle mechanism illustrated in FIG. 16, shown with the door handle mechanism in an unlocked and unactuated state.
Figure 19:
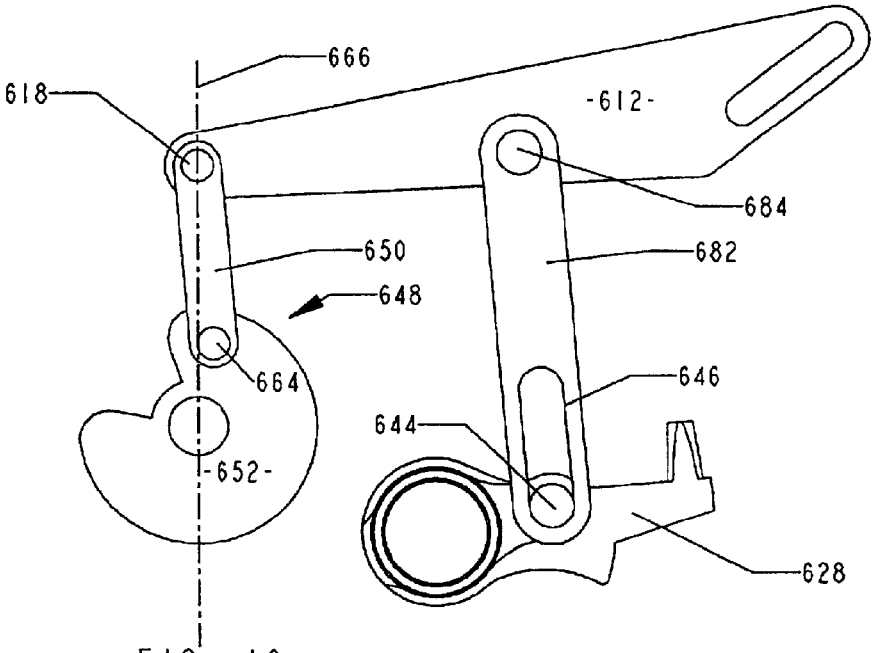
FIG. 19 is an elevational view of the door handle mechanism illustrated in FIG. 16, shown with the door handle mechanism in an unlocked and actuated state.

With reference next to FIG. 18, the second element 652 can instead be rotated in an opposite direction (clockwise as viewed in FIGS. 16–19) to move the pivot post 664 to an opposite side of the center position 666 of the second element 652. The second element 652 preferably rotates until stopped by one or more stops (also not shown). As shown in FIG. 19, the control lever 612 in this position can move the pawl 644 due to the position of the pawl post 644 in the link aperture 646. Specifically, subsequent actuation of the control lever 612 causes the control lever 612 to pivot about the control lever pivot 618, whereby force is transferred through the first element 650 to the stopped second element while the link 682 pushes the pawl post 644 to move the pawl 628. Therefore, the control lever 612 is unlocked in this state.

Although the locking and unlocking mechanisms 48, 148, 248, 348, 448, 548, 648 described above and illustrated in the figures are each an over-center device, any other element, device, or mechanism capable of moving the control lever 12, 112, 212, 312, 412, 512, 612 to different positions with respect to the pawl 28, 128, 228, 328, 428, 528, 628 can instead be employed. By way of example only, the control lever 12, 112, 212, 312, 412, 512, 612 can be connected in any conventional manner to a solenoid, hydraulic or pneumatic cylinder, motor, or any other driving device capable of moving the control lever 12, 112, 212, 312, 412, 512, 612. In other embodiments, the control lever can be driven by an electromagnet set on the control lever 12, 112, 212, 312, 412, 512, 612 and on a latch assembly housing wall 14, 114, 214, 314, 414, 514, 614 or other structure adjacent to the control lever 12, 112, 212, 312, 412, 512, 612, can be cammed against or otherwise moved directly or indirectly by one or more rotating elements driven by an electric motor, and the like. Any element, device, or mechanism that can be employed to move the control lever 12, 112, 212, 312, 412, 512, 612 to different positions in the latch assembly 10, 110, 210, 310, 410, 510, 610 is considered to fall within the spirit and scope of the present invention.

In this regard, it should be noted that an element, device, or mechanism can be used to move the control lever 12, 112, 212, 312, 412, 512, 612 to one position and a second element, device, or mechanism can be used to move the control lever 12, 112, 212, 312, 412, 512, 612 to another position. For example, an actuator can push a peripheral edge of the control lever 12, 112, 212, 312, 412, 512, 612 to move the control lever 12, 112, 212, 312, 412, 512, 612 to an unlocked position with respect to the pawl 28, 128, 228, 328, 428, 528, 628, while one or more springs or other biasing elements connected to the control lever 12, 112, 212, 312, 412, 512, 612 can push or pull the control lever 12, 112, 212, 312, 412, 512, 612 back to a locked position when the actuator is released.

In some embodiments of the present invention described above, the elements defining the locking and unlocking mechanism do not move or are relatively stationary in both their locked and unlocked states. For example, the locking and unlocking mechanisms 48, 148 in the first and second preferred embodiments illustrated in FIGS. 1–7 and 8, respectively, are biased into their locked and unlocked positions as described above. When the control levers 12, 112 in such embodiments are actuated while the locking and unlocking mechanisms 48, 148 are in their locked states, the locking and unlocking mechanisms 48, 148 remain stationary or substantially stationary. Alternatively however, either or both components 50, 52, 150, 152 of these mechanisms can move to some degree in either or both states, such as through an amount of rotation, shifting, or other movement responsive to control handle actuation.

In other embodiments of the present invention described above, the elements defining the locking and unlocking mechanism do not move or are relatively stationary when the control lever is actuated in one state (e.g., locked or unlocked) but can and do move when the control lever is actuated in another state (e.g., unlocked or locked, respectively). The illustrated preferred embodiments of FIGS. 9 and 10 provide examples of such locking and unlocking mechanisms.

In still other embodiments, the locking and unlocking mechanism is movable in both states: a locked state in which the elements defining the locking and unlocking mechanism are movable but incapable of transmitting sufficient motive force to the pawl to unlatch the latch, and an unlocked state in which these elements are movable and capable of transmitting sufficient motive force to the pawl to unlatch the latch.

Latch assemblies employing over-center locking and unlocking mechanisms (used to lock and unlock a control lever) have a number of significant advantages over latch assemblies with conventional locking and unlocking mechanisms. Unlike conventional mechanisms, a number of embodiments of the over-center locking and unlocking mechanism can hold themselves in locked or unlocked positions against forces applied by the control lever without power supplied to the locking and unlocking mechanisms. Also, over-center locking and unlocking mechanisms can help to retain the control lever in its locked or unlocked state against forces that can be generated upon release of the user-manipulatable device (e.g., door handle or lever) connected to the control lever. In addition, the present invention can employ one or more pivot joints for moving the locking and unlocking mechanism between its locked and unlocked states.

In order for a number of conventional latch assemblies to properly respond to an unlatching input to the latch assembly, at least one linkage, mechanism, or element must engage with at least one other linkage, mechanism, or element. In contrast, the use of an over-center locking and unlocking mechanism as described above can eliminate the need for such engagement and disengagement operations and can thereby result in smoother latch operation. Also, an over-center locking and unlocking mechanism can be well-suited for exerting force against a partially or fully-actuated control lever so that movement of the mechanism to an unlocked position generates pawl release (as will be described in greater detail below).

Unlike many conventional locking and unlocking mechanisms, the locking and unlocking mechanism in some embodiments of the present invention can be connected to the control lever (see, for example, the embodiments of the present invention shown in FIGS. 1–19). Such connection to the control lever can stabilize control lever movement and can provide additional control over the control lever. In addition, because the elements of the locking and unlocking mechanism 48, 148, 248, 348, 448, 548, 648 can be of any length and shape, the latch input(s) (solenoids or other actuators, mechanical connections to cables, rods, or other elements, and the like) to the locking and unlocking mechanism can be located a distance from the subject control lever, thereby permitting the locking and unlocking mechanism to be readily adapted to a number of different latch assemblies. Also, the relative lengths of the elements in the locking and unlocking mechanism can be adjusted to provide for different mechanical advantages of the locking and unlocking mechanism 48, 148, 248, 348, 448, 548, 648 without requiring a change in the location of the input(s) connected to the locking and unlocking mechanism 48, 148, 248, 348, 448, 548, 648.

In each embodiment of the present invention described above, the locking and unlocking mechanism 48, 148, 248, 348, 448, 548, 648 is connected to a control lever 12, 112, 212, 312, 412, 512, 612. However, it should be noted that the locking and unlocking mechanism of the present invention need not necessarily be connected to the control lever in order to perform the functions described above.

For example, the first element or link 50, 150, 250, 350, 450, 550, 650 can be positioned to move and hold the control lever 12, 112, 212, 312, 412, 512, 612 in a desired position in a number of different manners, such as by one or more external surfaces of the first element or link 50, 150, 250, 350, 450, 550, 650 blocking movement of the outside handle control lever 12, 112, 212, 312, 412, 512, 612 in one or more directions. By way of example only, and with reference to the embodiment of the present invention illustrated in FIG. 8, the first link 150 need not necessarily be connected to the control lever 112 by the pivot 118. An end of the first link 150 can instead press against an edge, side, or other surface of the control lever 112 to move the control lever 112 with respect to the pawl 128. For improved engagement of the first link 150 with the control lever 112 in such a case, the control lever 112 can be shaped (with a recess, elbow, groove, and the like) to urge the end of the first link 150 into a desired contact area of the control lever 112. Therefore, in some preferred embodiments of the present invention, the locking and unlocking mechanism need not necessarily be connected to a control lever to place the control lever in its locked and unlocked states. A linkage of the locking and unlocking mechanism should at least be movable into and out of a position whereby a surface of the linkage blocks, retains, or otherwise limits motion of the control lever. It should be noted that motion of the control lever in this state can be limited to rotation about or near the point at which the linkage blocks, retains, or otherwise limits motion of the control lever (as is the case in the preferred embodiments illustrated in FIGS. 1–19), or can be limited to sliding, translation, or other types of movement in other embodiments of the present invention.

In the preferred embodiments of the present invention illustrated in FIGS. 1–19, the control lever 12, 112, 212, 312, 412, 512, 612 moves in one manner when blocked, retained, or otherwise limited by a locking and unlocking mechanism 48, 148, 248, 348, 448, 548, 648 and in another manner when not so blocked, retained, or otherwise limited by the locking and unlocking mechanism 48, 148, 248, 348, 448, 548, 648. These manners of motion do not necessarily have to correspond to the unlocked and locked states of the control lever 12, 112, 212, 312, 412, 512, 612 as is the case in the illustrated preferred embodiments. One having ordinary skill in the art will appreciate that the locked and unlocked states can be reversed in other embodiments of the present invention, given readily identifiable changes in control lever and unlocking and locking element positions, connections, and relative orientations. Examples of such changes include relocation of the pawl post 44, 144, 244, 344, 444, 544, 644 to a different position with respect to the control lever 12, 112, 212, 312, 412, 512, 612 and/or changing the location of the locking and unlocking mechanism to block, retain, or otherwise limit another portion of the control lever 12, 112, 212, 312, 412, 512, 612, and the like. One aspect of the present invention resides not in the manner in which a control lever triggers release of the pawl, but in how the control lever is placed in its locked and unlocked positions (incapable and capable of moving to trigger pawl release) based upon the position of the locking and unlocking mechanism relative to the control lever.

As described above, the control lever can be blocked, retained, or otherwise limited in motion by the locking and unlocking mechanism in either or both of its locked and unlocked states. Therefore, it should be noted that the control lever need not necessarily be free to move without limitation from the locking and unlocking mechanism in the unlocked state. In different embodiments of the present invention, movement of the control lever can be partially or fully defined by the locking and unlocking mechanism in either or both states.

A number of preferred embodiments of the present invention have a significant advantage based upon the ability of the control lever to be moved a distance from the pawl when the control lever is in its locked state. Specifically, it is desirable in some applications to remove the control lever a distance from the pawl in the unlocked state. This distance reduces the ability of the control lever to exert force against the pawl due to severe impact, shock, or vibration of the latch assembly because the mass of the control lever is removed from the pawl. For example, in some embodiments such as the those illustrated in FIGS. 8–10 and 15, the control lever 112, 212, 312, 512 is moved so that it is located a distance from the pawl when the control lever 112, 212, 312, 512 is in its unlocked state.

Another significant advantage offered by some preferred embodiments of the present invention is the ability to unlatch the latch assembly after the control lever has been partially or fully actuated. This feature will be now be described with reference to the first embodiment of the present invention, although any of the illustrated preferred embodiments of FIGS. 1–19 can have this capability as will be described in greater detail below.

With reference to FIG. 6 of the first preferred embodiment, the latch assembly 10 is shown in its locked and actuated state. For example, the handle or other user-manipulatable device connected to the control lever 12 has been actuated but has not generated release of the pawl 28 because the control lever 12 is not in position with respect to the pawl 28 to move the pawl post 44. However, if the locking and unlocking mechanism 48 is moved to its unlocked position while the control lever 12 is partially or completely actuated, the control lever 12 can preferably be driven to an unlocked position to release the pawl 28 without re-actuating the control lever 12. This is in contrast to many conventional latch assemblies in which the control lever 12 must be re-actuated to release the pawl 28 in such a case.

With continued reference to FIG. 6, the locking and unlocking mechanism 48 can be moved to its unlocked state by clockwise rotation of the second element 52 about its axis 54. By this rotation, the pivot post 64 is moved across the center position 66, pulling the first element 50 in the same direction. Because the control lever 12 is connected to the first element 50, the control lever 12 is thereby moved with respect to the pawl 28. This motion of the control lever 12 causes the aperture 46 in the control lever 12 to move with respect to the pawl post 44, eventually pushing the pawl post 44 and moving the pawl 28. If the control lever 12 has been actuated sufficiently, the pawl 28 is released from the ratchet 30. Therefore, movement of the locking and unlocking mechanism 48 from the unlocked state shown in FIGS. 3 and 4 to the locked state shown in FIGS. 5 and 6 when the control lever 12 has been actuated sufficiently generates release of the latch without re-actuation of the control lever 12.

Although each of the illustrated embodiments of the present invention has the latch releasing capability just described, it should be noted that some embodiments do not. The other inventive aspects of the present invention described herein do not require this type of latch releasing capability.

As just mentioned, each of the illustrated preferred embodiments of FIGS. 1–19 is capable of pawl release upon movement of the locking and unlocking mechanism 48, 148, 248, 348, 448, 548, 648 to an unlocked position without re-actuation of the control lever 12, 112, 212, 312, 412, 512, 612. For example, movement of the locking and unlocking mechanism 148 of the second embodiment illustrated in FIG. 8 to the left across the center position 66 after the control lever 112 has been actuated preferably causes the control lever 112 to move the pawl post 144 to release the pawl 128. Movement of second element 252 in the locking and unlocking mechanism 248 of the third preferred embodiment to the left after the control lever 212 has been actuated preferably causes the control lever 212 to move the pawl post 244 and release the pawl 228. As another example, rotation of the second element 352 in the locking and unlocking mechanism 348 of the fourth preferred embodiment to its unlocked position (shown in solid lines in FIG. 10) after the control lever 312 has been actuated preferably causes the control lever 312 to move the pawl post 344 and release the pawl 328.

Depending upon the relative positions of the elements defining the locking and unlocking mechanism 48, 148, 248, 348, 448, 548, 648 and the control lever 12, 112, 212, 312, 412, 512, 612 and depending upon the manner in which the locking and unlocking mechanism 48, 148, 248, 348, 448, 548, 648 is connected or otherwise acts upon the control lever 12, 112, 212, 312, 412, 512, 612, the control lever 12, 112, 212, 312, 412, 512, 612 may need to be fully actuated to release the pawl 28, 128, 228, 328, 428, 528, 628 when the locking and unlocking mechanism 48, 148, 248, 348, 448, 548, 648 is moved to its unlocked state as described above. In other embodiments of the present invention, only partial actuation of the control lever 12, 112, 212, 312, 412, 512, 612 is required to generate pawl release in such a case.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, each of the preferred embodiments illustrated in FIGS. 1–19 employs an over-center biasing mechanism to retain a control lever in its locked and unlocked positions with respect to a pawl. Also, in the embodiments illustrated in FIGS. 1–10 and 16–19, the locking and unlocking mechanism causes the control lever to pivot about the same point with respect to the control lever in the locked and unlocked states of the control lever. While both of these latch features are highly desirable, it should be noted that latch assemblies according to the present invention can have either one of these features (rather than both) as desired. Specifically, a latch assembly according to the present invention can have a control lever that pivots about different points when locked and unlocked using an over-center locking and unlocking mechanism. Alternatively, a latch assembly according to the present invention can have a control lever that pivots about the same point with respect to the control lever using an element, actuator, or device that is not an "over-center" element, actuator, or device.

Throughout the specification and claims herein, when one element is said to be "coupled" to another, this does not necessarily mean that one element is fastened, secured, or otherwise attached to another element. Instead, the term "coupled" means that one element is either connected directly or indirectly to another element or is in mechanical communication with another element. Examples include directly securing one element to another (e.g., via welding, bolting, gluing, frictionally engaging, mating, etc.), elements which can act upon one another (e.g., via camming, pushing, or other interaction) and one element imparting motion directly or through one or more other elements to another element.

I claim:

1. A method of operating a latch assembly having a ratchet releasably engagable with a pawl, the method comprising:

pivoting a lever about a pivot point substantially fixed with respect to the lever and located in a first position with respect to a body of the latch apparatus, the lever incapable of exerting sufficient motive force to release the ratchet from engagement with the pawl when the pivot point is located in the first position;

moving the lever and the pivot point away from the first position with respect to the body of the latch apparatus while the lever remains at least partially actuated;

moving the lever and the pivot point to a second position with respect to the body of the latch apparatus while the lever remains at least partially actuated; and moving the pawl with the lever to release the ratchet from engagement with the pawl by moving the lever and the pivot point toward the second position.

2. The method as claimed in claim 1, wherein moving the pawl occurs after the pivot point of the lever is moved to the second position.

3. The method as claimed in claim 1, wherein moving the pawl occurs while the lever is moved and while the lever remains pivoted.

4. The method as claimed in claim 1, wherein moving the lever to move the pivot point to the second position includes translating the lever with respect to the pawl.

5. The method as claimed in claim 1, wherein moving the lever to move the pivot point to the second position includes rotating the lever with respect to the pawl.

6. The method as claimed in claim 1, wherein moving the lever to move the pivot point to the second position includes translating and rotating the lever with respect to the pawl.

7. The method as claimed in claim 1, further comprising:

providing an actuator coupled to the lever; and actuating the actuator to move the lever.

8. The method as claimed in claim 1, further comprising an over-center device coupled to the lever, the over-center device movable between two stable positions corresponding to the first and second positions of the pivot point.

9. A latch assembly, comprising:

a pawl having:

an unlatched position; and a latched position;

a lever movable with respect to the pawl;

a rotatable member coupled to the lever and mounted for rotation about an axis, wherein the lever is movable by rotation of the rotatable member coupled thereto, the rotatable member rotatable between:

a first position in which the lever is actuatable to move the pawl to the unlatched position;

a second position in which actuation of the lever is incapable of generating movement of the pawl to the unlatched position, movement of the rotatable member from the second position to the first position during actuation of the lever generating movement of the pawl; and the rotatable member is part of an over-center device coupled to the lever.

10. The latch assembly as claimed in claim 9, wherein the lever is movable between an unlocked position and a locked position corresponding to the first and second positions of the rotatable member, respectively, the lever pivotable about substantially the same location with respect to the lever in the unlocked and locked positions.

11. The latch assembly as claimed in claim 9, wherein:

the rotatable member is a first rotatable member; and the lever is coupled to the first rotatable member by a second rotatable member coupled to the lever and to the first rotatable member.

12. The latch assembly as claimed in claim 11, wherein:

first and second connections are defined between the lever and the second rotatable member and between the second rotatable member and the first rotatable member, respectively; and at least one of the first and second connections is a lost-motion connection.

13. The latch assembly as claimed in claim 9, wherein the lever is rotatably coupled to the rotatable member.

14. The latch assembly as claimed in claim 9, wherein:

the lever is coupled to a first end of the rotatable member, and the rotatable member is rotatable about a second end opposite the first end.

15. The latch assembly as claimed in claim 9, wherein the first position of the rotatable member is one of a range of positions of the rotatable member in which the lever is actuatable to move the pawl to the unlatched position.

16. The latch assembly as claimed in claim 9, wherein the second position of the rotatable member is one of a range of positions of the rotatable member in which the lever is incapable of generating movement of the pawl to the unlatched position.

17. The latch assembly as claimed in claim 9, wherein the lever is incapable of moving the pawl in the second position of the rotatable member.

18. A latch assembly, comprising:

a pawl movable between a latched position and an unlatched position;

a lever having at least one unlocked position in which the lever is actuatable to move the pawl to the unlatched position; and at least one locked position in which the lever is incapable of moving the pawl to the unlatched position;

an over-center device coupled to the lever at a first pivot and moveable about a second pivot, the over-center device having a first stable position in which the lever is positioned in the unlocked position by the over-center device with respect to the pawl;

a second stable position in which the lever is positioned in the locked position by the over-center device with respect to the pawl; and at least one unstable position located between the first and second stable positions, the at least one unstable position located along a line extending through the first and second pivots when the over-center device is in either stable position, wherein actuation of the lever urges the over-center device away from the unstable position and toward either of the first and second stable positions.

19. The latch assembly as claimed in claim 18, further comprising a ratchet releasably engagable with the pawl and having latched and unlatched positions corresponding to the latched and unlatched positions of the pawl.

20. The latch assembly as claimed in claim 19, wherein the first pivot is located in substantially the same location with respect to the lever in at least one unlocked position of the lever and in at least one locked position of the lever.

21. The latch assembly as claimed in claim 18, wherein the over-center device includes a first element and a second element pivotably coupled to one another at a third pivot, the first element also coupled to the lever.

22. The latch assembly as claimed in claim 21, wherein the first element is pivotably coupled to the lever at the first pivot.

23. The latch, assembly as claimed in claim 22, wherein:

the second element is pivotable about the second pivot; and the first and second stable positions and the at least one unstable center position is defined by different pivotal positions of the first element with respect to the second element.

24. The latch assembly as claimed in claim 18, wherein the first and second stable positions are on opposite sides of the line.

25. The latch assembly as claimed in claim 21, wherein the first and second elements are pivotably coupled together by a lost-motion connection.

26. The latch assembly as claimed in claim 21, wherein:

the second element is pivotable about the second pivot; and the latch assembly further comprising an angle between the line extending through the first and second pivot points and a second line extending through the first and third pivot points, the angle having different sizes defined by different relative positions of the first element with respect to the second element, the angle limited to acute angle sizes.

27. The latch assembly as claimed in claim 21, wherein: the second element has a fourth pivot point about which the second element is pivotable, the fourth pivot point located a distance from the first pivot point, the latch assembly further comprising an angle between a first line extending through the first and second pivot points and a second line extending through the first and fourth pivot points, the angle having different sizes defined by different relative positions of the first element with respect to the second element, the angle limited to obtuse angle sizes.

28. The latch assembly as claimed in claim 21, wherein the second element is movable to cam against the first element.

29. The latch assembly as claimed in claim 21, wherein at least one of the first and second elements has a rotational range limited by at least one stop in at least one of the locked and unlocked positions of the over-center device.

30. The latch assembly as claimed in claim 21, wherein the first and second elements are rotatable through respective ranges of positions limited only by a range of movement of the lever.

31. The latch assembly as claimed in claim 18, wherein the over-center device includes first and second elements movable with respect to one another, the first element coupled to the lever and positioned to ride upon a surface of the second element that is inclined with respect to the first element.

32. The latch assembly as claimed in claim 18, wherein the over-center device includes first and second elements movable with respect to one another, the second element rotatable about a second pivot, the first element coupled to the lever and positioned to ride upon a surface of the second element.

33. A method of operating a latch assembly, comprising:

providing a lever coupled to a pawl and movable with respect to the pawl, the lever having a first position with respect to the pawl in which actuation of the lever is incapable of moving the pawl sufficiently to unlatch the latch assembly;

moving at least a portion of an over-center device about a first pivot from a first stable position toward a center position, the over-center device coupled to the lever at a second pivot, the center position located along a line extending through the first and second pivots;

moving the at least a portion of the over-center device past the center position toward a second stable position;

moving the lever from the first position with respect to the pawl to a second position with respect to the pawl responsive to movement of the at least a portion of the over-center device;

actuating the lever in the second position; and moving the pawl to unlatch the latch assembly responsive to actuation of the lever in the second position.

34. The method as claimed in claim 33, wherein the lever is moved from the first position with respect to the pawl to the second position with respect to the pawl during movement of the over-center device from the first stable position toward the center position.

35. The method as claimed in claim 33, wherein the lever is moved from the first position with respect to the pawl to the second position with respect to the pawl during movement of the over-center device past the center position toward the second stable position.

36. The method as claimed in claim 33, wherein the over-center device includes first and second elements rotatably coupled to one another, the second element also coupled to the lever, the method further comprising:

rotating the first element of the over-center device;

rotating the second element of the over-center device responsive to rotation of the first element; and moving the lever responsive to rotating the second element of the over-center device coupled to the lever.

37. The method as claimed in claim 36, further comprising stopping rotation of at least one of the first and second elements of the over-center device by a stop, the over-center device in the first stable position when the at least one of the first and second elements is stopped by the stop.

38. The method as claimed in claim 36, further comprising stopping rotation of at least one of the first and second elements of the over-center device by a stop, the over-center device in the second stable position when the at least one of the first and second elements is stopped by the stop.

39. The method as claimed in claim 33, wherein the over-center device includes a first element movably coupled to a second element, the method further comprising riding the first element upon a surface of the second element inclined with respect to the first element.

40. The method as claimed in claim 33, wherein the over-center device includes a first element movably coupled to a second element, the method further comprising riding the first element upon a surface of the second element as the second element rotates about an axis.

41. The method as claimed in claim 33, wherein actuating the lever includes pivoting the lever about the second pivot.

42. The method as claimed in claim 41, wherein moving the lever includes moving the second pivot with respect to the pawl.

43. The method as claimed in claim 41, wherein the second pivot is located in substantially the same position with respect to the lever in the first and second positions of the lever.

44. The method as claimed in claim 33, wherein the over-center device is biased toward at least one of the first and second stable positions and away from the center position upon movement of the over-center device to a corresponding side of the center position.

45. The method as claimed in claim 33, wherein:

the over-center device has a first element and a second element pivotably coupled to the first element and coupled to the lever;

the first element has a range of pivot positions with respect to the second element, the range of pivot positions including the center position; and moving the over-center device includes pivoting one of the first and second elements with respect to the other of the first and second elements.

46. The method as claimed in claim 33, wherein:

the over-center device includes a first element pivotably coupled at a third pivot to a second element and pivotable about the first pivot;

the lever is pivotably coupled to the second element at the second pivot, the method further comprising moving the second pivot point across a line passing through the first and second pivots, the line defining the center position of the over-center device.

47. The method as claimed in claim 33, wherein moving the lever includes at least one of pushing and pulling the over-center device against the lever.

48. The method as claimed in claim 33, wherein moving the lever includes pivoting the lever with respect to the over-center device.

* * * * *